US007758153B2

(12) United States Patent
Tanaka et al.

(10) Patent No.: US 7,758,153 B2
(45) Date of Patent: Jul. 20, 2010

(54) PRINTING APPARATUS AND PRINTHEAD TEMPERATURE RETAINING CONTROL METHOD

(75) Inventors: Hirokazu Tanaka, Tokyo (JP); Hidehiko Kanda, Yokohama (JP); Atsushi Sakamoto, Kawasaki (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 162 days.

(21) Appl. No.: 11/970,162

(22) Filed: Jan. 7, 2008

(65) Prior Publication Data

US 2008/0165217 A1 Jul. 10, 2008

(30) Foreign Application Priority Data

Jan. 9, 2007 (JP) ..... 2007-001832

(51) Int. Cl.
*B41J 2/165* (2006.01)

(52) U.S. Cl. ..... 347/35; 347/17

(58) Field of Classification Search ..... None
See application file for complete search history.

(56) References Cited

U.S. PATENT DOCUMENTS 6,276,790 B1 * 8/2001 Ikezaki ..... 347/88
2005/0270322 A1 * 12/2005 Uji et al. ..... 347/14
2007/0216714 A1 * 9/2007 Sato ..... 347/5

FOREIGN PATENT DOCUMENTS

| | | |
|---|---|---|
| JP | 05-092565 | 4/1993 |
| JP | 06-278291 | 10/1994 |
| JP | 08-336962 | 12/1996 |
| JP | 11-192727 | 7/1999 |
| JP | 11-342604 | 12/1999 |

* cited by examiner

*Primary Examiner*—Matthew Luu
*Assistant Examiner*—Justin Seo
(74) *Attorney, Agent, or Firm*—Fitzpatrick, Cella, Harper & Scinto

(57) ABSTRACT

The object of this invention is to provide a printing apparatus and printhead temperature retaining control method capable of suppressing power consumption, and reducing degradation in image quality. To achieve the object, a printing apparatus for printing an image on a printing medium by discharging ink, executes the following processes. A first temperature adjustment process is executed to adjust the printhead temperature to a first adjustment temperature during the non-printing period in which preparation for printing the image is executed by discharging ink from the orifices. Additionally, a second temperature adjustment process is executed to adjust the printhead temperature to a second adjustment temperature during a printing period in which the image is printed on the printing medium by discharging ink from the orifices. The process is executed while providing a quiescent period without printhead temperature adjustment between the first and second temperature adjustment processes.

8 Claims, 18 Drawing Sheets

PRINTING APPARATUS AND PRINTHEAD TEMPERATURE RETAINING CONTROL METHOD

BACKGROUND OF THE INVENTION

1. Field of the Invention

The present invention relates to a printing apparatus and a printhead temperature retaining control method. Particularly, the present invention relates to a printing apparatus which causes a printhead to discharge ink to print an image on a printing medium, and a temperature retaining control method for the printhead.

2. Description of the Related Art

In recent years, the need for high-performance printing apparatuses used as a printer, copying machine, facsimile apparatus, and the like is growing, and a printing apparatus is required to be capable of not only high-speed printing or full-color printing but also high-resolution image printing with the quality of silver halide photos. Regarding these requests, inkjet printing apparatuses which can implement high-speed high-quality printing by discharging very small ink droplets at a high frequency are superior to printing apparatuses employing other printing methods. Among inkjet printing apparatuses, a printing apparatus employing a thermal inkjet printing method of discharging ink using bubbles generated by heaters (electrothermal transducers) can have nozzles at a high density and therefore print a high-quality image.

The above-described thermal inkjet printing method (to be simply referred to as an inkjet printing method hereinafter) has the following characteristic features.

In the inkjet printing method, electric power is supplied to heaters to generate thermal energy which forms bubbles in ink. Growth of the bubbles is largely influenced by ink temperature in the vicinity. At the interfaces between bubbles and ink, a process of popping molecules in the gaseous phase from the bubbles to the ink and a process of popping molecules in the liquid phase from the ink to the bubbles occur. The ink temperature near bubbles influences the latter process. If the ink temperature is high, many molecules pop out from the ink to the bubbles, and the bubbles grow relatively large. Conversely, if the ink temperature is low, the number of molecules popping out from the ink to the bubbles is relatively small, and the bubble size is smaller than that at a high ink temperature. The bubble size is reflected on the volume (to be referred to as an ink discharge amount hereinafter) of ink pushed out from the nozzles or the ink discharge speed (to be referred to as a discharge speed hereinafter).

Hence, in the inkjet printing apparatus, the amount of ink discharge and discharge speed are greatly affected by the ink temperature near the heaters (to be referred to as an ink temperature hereinafter). If the ink temperature is high, the amount of ink discharge is large, and the discharge speed is high. On the other hand, if the ink temperature is low, the amount of ink discharge is small, and the discharge speed is low.

As another characteristic feature of the inkjet printing method, the temperature near the heaters becomes higher during printing than before the start of printing.

This is because the thermal energy generated by the heaters does not totally contribute to bubble forming. A surplus obtained by subtracting the energy required for bubble forming from the thermal energy is stored as thermal energy in ambient ink and members such as a printhead substrate. The stored thermal energy is dissipated by thermal conduction or thermal radiation. However, since the heaters continue to supply thermal energy during printing, the ink temperature continues to rise when the amount of thermal energy dissipation is smaller than the amount of supply. On the other hand, during non-printing without thermal energy supply from the heaters, the ink temperature continues to drop down to the equilibrium state with the ambient temperature. In other words, portions that are printed at a high ink temperature and portions that are printed at a low ink temperature almost equal to room temperature exist on a printing medium depending on the number of times of heater drive, that is, print data.

For this reason, the amount of ink discharge changes between the high-temperature portions and the low-temperature portions. Particularly in printing a photo-quality image, the density of the output image or the ink landing positions on the printing medium change. This may cause density unevenness on the printed image and degrade the printing quality.

Conventionally, a temperature retaining control method is known as a measure against variations in the amount of ink discharge and discharge speed depending on the ink temperature. This method holds the printhead at a relatively high predetermined temperature, thereby suppressing variations in the amount of ink discharge and discharge speed. In a method proposed in, for example, Japanese Patent Laid-Open No. 6-278291, a temperature (reference temperature) capable of reducing the variation width of the amount of ink discharge is predetermined, and the printhead is heated up to the reference temperature during a non-printing state (non-printing period) in which preparations for printing such as printing medium conveyance and preliminary discharge are performed.

In methods proposed in Japanese Patent Laid-Open Nos. 8-336962, 11-192727, and 11-342604, the printhead is heated during a non-printing state including an acceleration period during printhead scanning for the above-described temperature retaining control.

The temperature retaining control is effective for the above-described problems of variations in the amount of ink discharge and discharge speed and also advantageous because ink discharge can be performed with lower thermal energy. This is because heated ink has a low viscosity and can flow easily. More specifically, the temperature retaining control enables ink discharge with lower thermal energy and also makes it possible to discharge more viscous ink while maintaining the thermal energy to be used, and therefore extend the range of choices of ink.

The conventional temperature retaining control methods have many advantages. Temperature retaining control starts in the non-printing state before the start of printing and continues until the start of printing and during printing (printing period). However, if heating is always continued to maintain the relatively high predetermined ink temperature from the non-printing state to the start of printing, the power consumption increases. Additionally, if temperature retaining control is always continued from the non-printing state to the start of printing and during printing, a large amount of heat is stored in the printhead. This may raise the printhead temperature more than necessary at the start of ink discharge immediately after the start of printing and make ink discharge unstable, resulting in degradation in image quality.

According to Japanese Patent Laid-Open No. 6-278291, a temperature (reference temperature) capable of reducing the variation width of the amount of ink discharge is predetermined. The printhead is heated up to the reference temperature during the non-printing state, and printing starts from this state. However, as described above, if heating is always continued to maintain the high ink temperature in the non-printing state to prepare for printing, the power consumption increases. Additionally, if the high ink temperature is maintained for a long time without ink discharge, the printhead stores a large amount of heat. This may raise the printhead temperature more than necessary at the start of ink discharge immediately after the start of printing and make ink discharge unstable, resulting in degradation in image quality.

In the temperature retaining control methods proposed in Japanese Patent Laid-Open Nos. 8-336962, 11-192727, and 11-342604, the printhead is heated during the non-printing state including an acceleration period during printhead scanning, instead of always heating the printhead from the non-printing state. These prior arts can solve the problem of power consumption of temperature retaining control in the non-printing state by limiting the temperature retaining control period in the non-printing state to prepare for printing. However, these methods continuously execute the temperature retaining control from its start to the start of printing. This may make ink discharge immediately after the start of printing unstable, resulting in degradation in image quality.

Furthermore, the conventional temperature retaining control aims at ink discharge during printing, and ink discharge executed in the non-printing state is not addressed. That is, no optimum temperature retaining control has been proposed for ink discharge (to be referred to as preliminary discharge hereinafter) which is periodically executed without using a printing medium in the non-printing state, that is, before the start of printing, during conveyance of a printing medium, or after the end of printing to prevent the ink from increasing the viscosity or solidifying when left stand for a long time or prevent mixture of ink colors.

SUMMARY OF THE INVENTION

Accordingly, the present invention is conceived as a response to the above-described disadvantages of the convention art.

For example, a printing apparatus and printhead temperature retaining control method according to this invention are capable of stably discharging ink while suppressing the power consumption even in a non-printing state in which preliminary discharge is executed, and also reducing degradation in image quality immediately after the start of printing.

According to one aspect of the present invention, preferably, there is provided a printing apparatus which prints an image on a printing medium by scanning a printhead while discharging ink from orifices by thermal energy of printing elements provided on the printhead, comprising: adjustment means for adjusting a temperature of the printhead to an adjustment temperature, wherein the adjustment means is capable of executing a first temperature adjustment process of adjusting the printhead temperature to a first adjustment temperature to execute preliminary discharge for discharging, to a portion outside the printing medium, ink that does not contribute to image printing before the image is printed on the print medium, and adjusting the printhead temperature to a second adjustment temperature to execute preliminary discharge during printing on the printing medium, and the first adjustment temperature is higher than the second adjustment temperature.

According to another aspect of the present invention, preferably, there is provided a printhead temperature retaining control method in a printing apparatus which prints an image on a printing medium by scanning a printhead while discharging ink from orifices by thermal energy of printing elements provided on the printhead, comprising the step of: adjusting a temperature of the printhead to an adjustment temperature to execute preliminary discharge for discharging, to a portion outside the printing medium, ink that does not contribute to image printing, wherein the adjustment temperature adjusted to execute the preliminary discharge before the image is printed on the printing medium is higher than the adjustment temperature adjusted to execute the preliminary discharge during printing on the printing medium.

The invention is particularly advantageous since temperature retaining control optimum for preliminary discharge can be provided. Additionally, upon executing temperature retaining control from a non-printing state, the power consumption in temperature retaining control in the non-printing state is suppressed, and unstable ink discharge and resultant degradation in image quality immediately after the start of printing are reduced.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Basic Arrangement of Inkjet Printing Apparatus (FIGS. 1A to 3)>

Figure 1A:
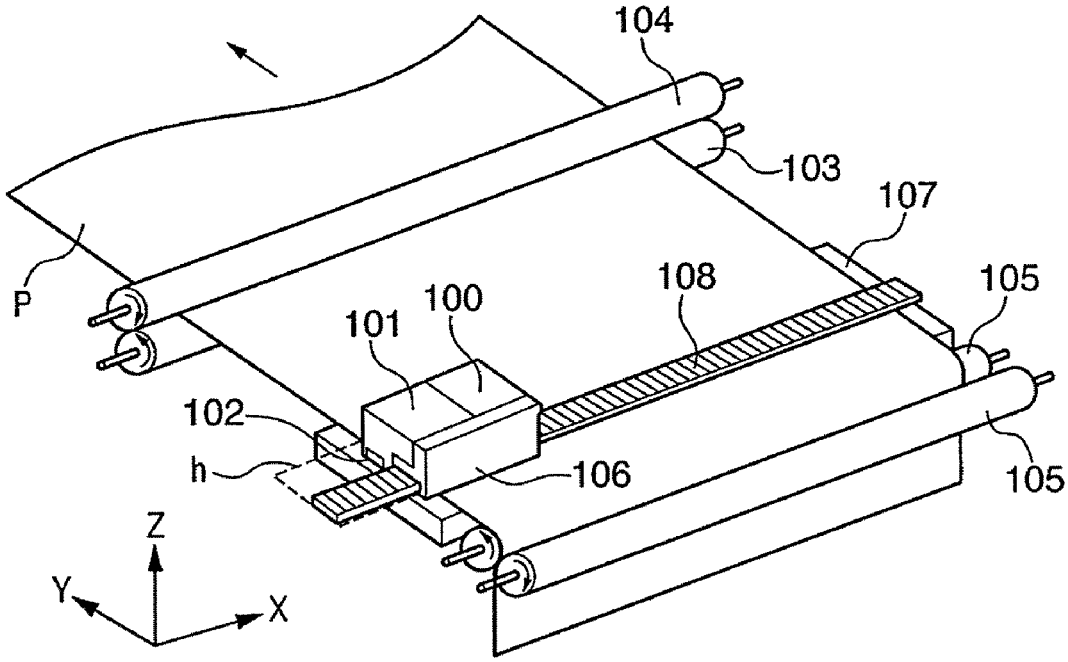
FIGS. 1A and 1B are views showing the schematic arrangement of a printing apparatus according to a typical embodiment of the present invention.
Figure 1B:
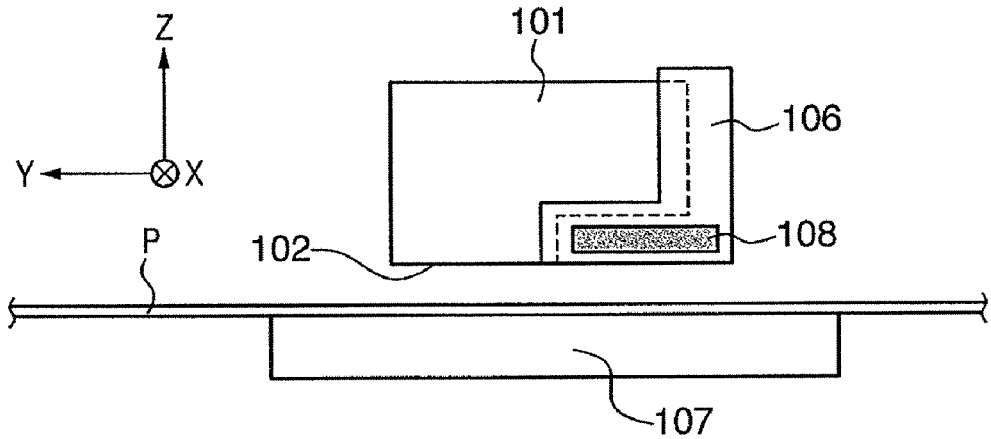

FIGS. 1A and 1B are views showing the schematic arrangement of a printing apparatus according to a typical embodiment of the present invention.

FIG. 1A is a perspective view of the printing apparatus. FIG. 1B is a sectional view of a printhead taken along a Y-Z plane in FIG. 1A.

Referring to FIGS. 1A and 1B, each of printheads 100 and 101 is integrated with an ink tank. Although FIGS. 1A and 1B show the ink-tank-integrated printheads, each printhead need not always have this shape and may be separated from the ink tank.

The printhead 100 contains black ink, light cyan ink, and light magenta ink in the ink tank. The printhead 101 contains cyan ink, magenta ink, and yellow ink in the ink tank. The printheads 100 and 101 have the same structure except the contained inks. Each of the printheads 100 and 101 has a plurality of orifices 102 arrayed in correspondence with each ink color.

Reference numeral 103 denotes a conveyance roller; and 104, an auxiliary roller. These rollers cooperatively convey a printing medium P as needed by rotating in the directions of arrows in FIG. 1A while pressing the printing medium P. Feed rollers 105 feed the printing medium P and also press it, like the conveyance roller 103 and auxiliary roller 104. A carriage 106 supports the printheads 100 and 101 and moves them as printing progresses. The carriage 106 stands by at a home position h indicated by the dotted line in FIG. 1A when printing is not executed, or a printhead recovery operation is performed. A platen 107 stably supports the printing medium P at the printing position. A carriage belt 108 scans the carriage 106 in the X direction.

Figure 2A:
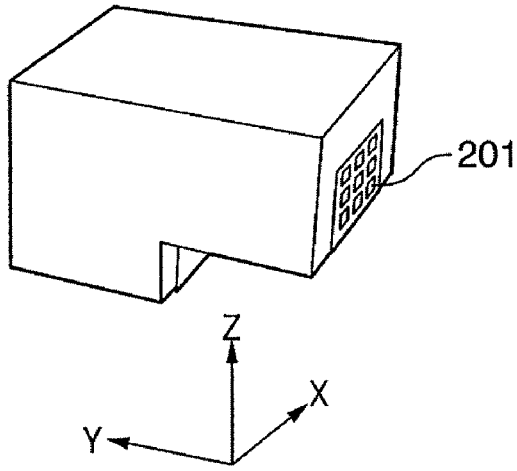
FIGS. 2A, 2B, and 2C are views showing the structure of a printhead.
Figure 2B:
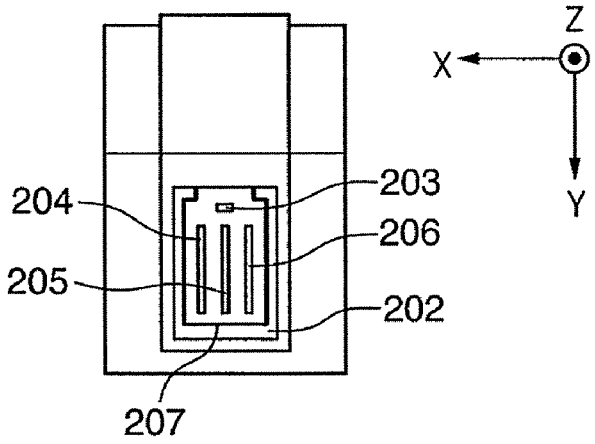
Figure 2C:
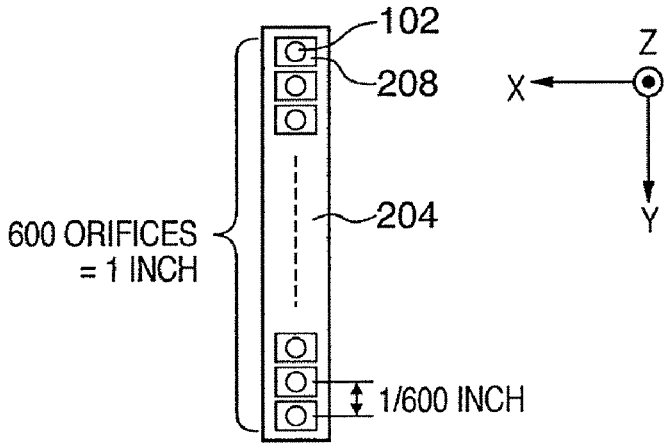

FIGS. 2A to 2C are views showing the structure of the printhead. Since the printheads 100 and 101 have the same structure, the structure of the printhead 101 will be described here.

FIG. 2A is a perspective view of the printhead 101. FIG. 2B is a bottom view showing the printhead viewed from the Z direction. FIG. 2C is an enlarged view of the neighborhood of orifices in FIG. 2B.

Referring to FIG. 2A, reference numeral 201 denotes a contact pad through which a print signal is received from the printing apparatus main body, and power necessary for driving the printhead is supplied.

Referring to FIG. 2B, reference numeral 202 denotes a printhead chip; and 203, a diode sensor which detects the temperature of the printhead substrate. It is difficult to directly detect the ink temperature. Generally, the temperature of the printhead substrate (to be referred to as a printhead temperature hereinafter) is detected, and the printhead temperature is adjusted based on the detected temperature. As the component to detect the printhead temperature, not the diode sensor but, for example, a metal thin film sensor may be used. An orifice array 204 discharges cyan ink. An orifice array 205 discharges magenta ink. An orifice array 206 discharges yellow ink. The orifice arrays have the same structure except the ink color. A sub-heater 207 for ink heating has a resistance of 100Ω and entirely surrounds the orifice arrays 204, 205, and 206. The sub-heater 207 determines in accordance with the presence/absence of application of a voltage of 20 V whether to heat the printhead substrate, thereby adjusting the printhead temperature (ink temperature). In the printing apparatus according to this embodiment, feedback control is performed by switching between heating and non-heating of the printhead substrate based on temperature information detected by the diode sensor 203 and a thermistor 315 (to be described later), thereby making the printhead temperature closer to an adjustment temperature.

FIG. 2C is an enlarged view of the orifice array 204 that discharges cyan ink.

Referring to FIG. 2C, the orifices 102 are arrayed on the cyan orifice array 204. Each orifice 102 has, under it (in the Z direction), an ink discharge heater 208 (to be also simply referred to as a heater hereinafter) with a resistance of 500Ω, which generates bubbles upon receiving a voltage of 20 V and causes the orifice to discharge ink. The number of orifices 102 arrayed on the cyan orifice array 204 is 600. The interval between the orifices 102 is 1/600 inch. The print pixel density is 600 dpi.

Regarding ink discharge, each orifice 102 can discharge an ink droplet of about 2 pl. The discharge frequency of the heater 208 to stably discharge the ink droplet is 24 kHz. That is, to print the ink droplets at an interval of 1,200 dpi in the main scanning direction, the main-scanning (X-axis) speed of the carriage 106 with the printheads 100 and 101 is 24000 (dots/sec)÷1200 (dots/inch)=20 inches/sec.

The color inks of black, light cyan, light magenta, cyan, magenta, and yellow which are discharged from the printheads 100 and 101 of this embodiment have the same ink discharge characteristics, that is, the same amount of ink discharge and discharge speed with respect to a temperature. The color inks are optimum for printing when the amount of ink discharge is 2 pl, and the discharge speed is 15 m/sec. The ink temperature that satisfies these conditions is 55° C. When the amount of ink discharge and discharge speed have values smaller than the optimum values for printing, the inks are unsuitable for printing. The critical temperature to tolerably discharge them is 45° C. At 45° C. or less, the discharge speed is low. Hence, discharged ink droplets cannot land on a printing medium, and the printing quality becomes poor. If the temperature lowers to almost room temperature, the ink viscosity increases, and it may be impossible to discharge the inks. On the other hand, when the ink temperature is as high as 75° C. or more, the amount of ink discharge increases, and ink supply cannot overtake discharge. As a result, discharge errors may take place.

Figure 3:
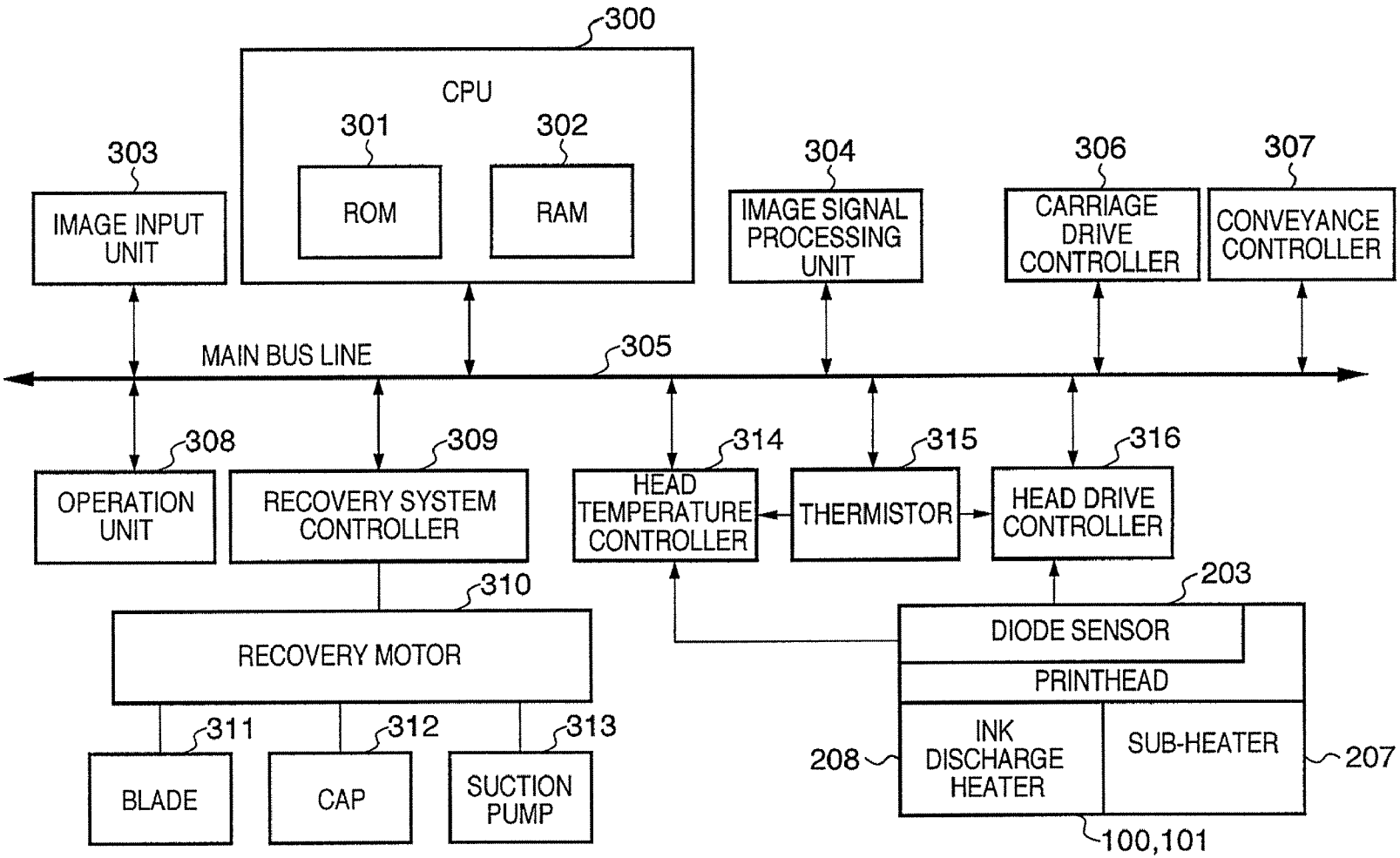
FIG. 3 is a block diagram showing the control arrangement of the printing apparatus shown in FIG. 1.

FIG. 3 is a block diagram showing the control arrangement of the printing apparatus.

The constituent elements of the control arrangement shown in FIG. 3 are roughly classified into a control means implemented by software and that is implemented by hardware. The control means implemented by software includes an image input unit 303 which accesses a main bus line 305, an image signal processing unit 304 corresponding to it, and a CPU 300. The control means implemented by hardware includes an operation unit 308, recovery system controller 309, head temperature controller 314, head drive controller 316, main-scanning carriage drive controller 306, and sub-scanning conveyance controller 307.

The CPU 300 normally has a ROM 301 and a RAM 302. The CPU 300 gives adequate print conditions to input information to drive the ink discharge heaters 208 in the printheads 100 and 101, thereby executing printing. The RAM 302 stores a program for executing a printhead recovery timing sequence in advance and supplies recovery conditions such as preliminary discharge conditions to the recovery system controller 309 and printheads 100 and 101 as needed. A recovery motor 310 drives the printheads 100 and 101, and a cleaning blade 311, cap 312, and suction pump 313 which separately oppose the printheads.

The head temperature controller 314 determines the drive conditions of the sub-heaters 207 on the printheads 100 and 101 based on the output values from the thermistor 315 that detects the ambient temperature of the printing apparatus and the diode sensor 203 that detects the printhead temperature. The head drive controller 316 drives the sub-heaters 207 based on the drive conditions. The head drive controller 316 drives not only the sub-heaters 207 but also the heaters 208 on the printheads 100 and 101 to make them adjust the ink temperature for preliminary discharge, ink discharge, or temperature retaining control. The program for executing the temperature retaining control (to be described later) of this embodiment is stored in, for example, the ROM 301 to execute printhead temperature detection and drive of the sub-heaters 207 via the head temperature controller 314 and head drive controller 316. The head drive controller 316 can also perform PWM control by driving the ink discharge heaters 208 in accordance with a drive signal containing a prepulse and a main pulse.

Embodiments of the printhead temperature retaining control method in the printing apparatus with the above-described arrangement will be described below.

First Embodiment

Figure 4:
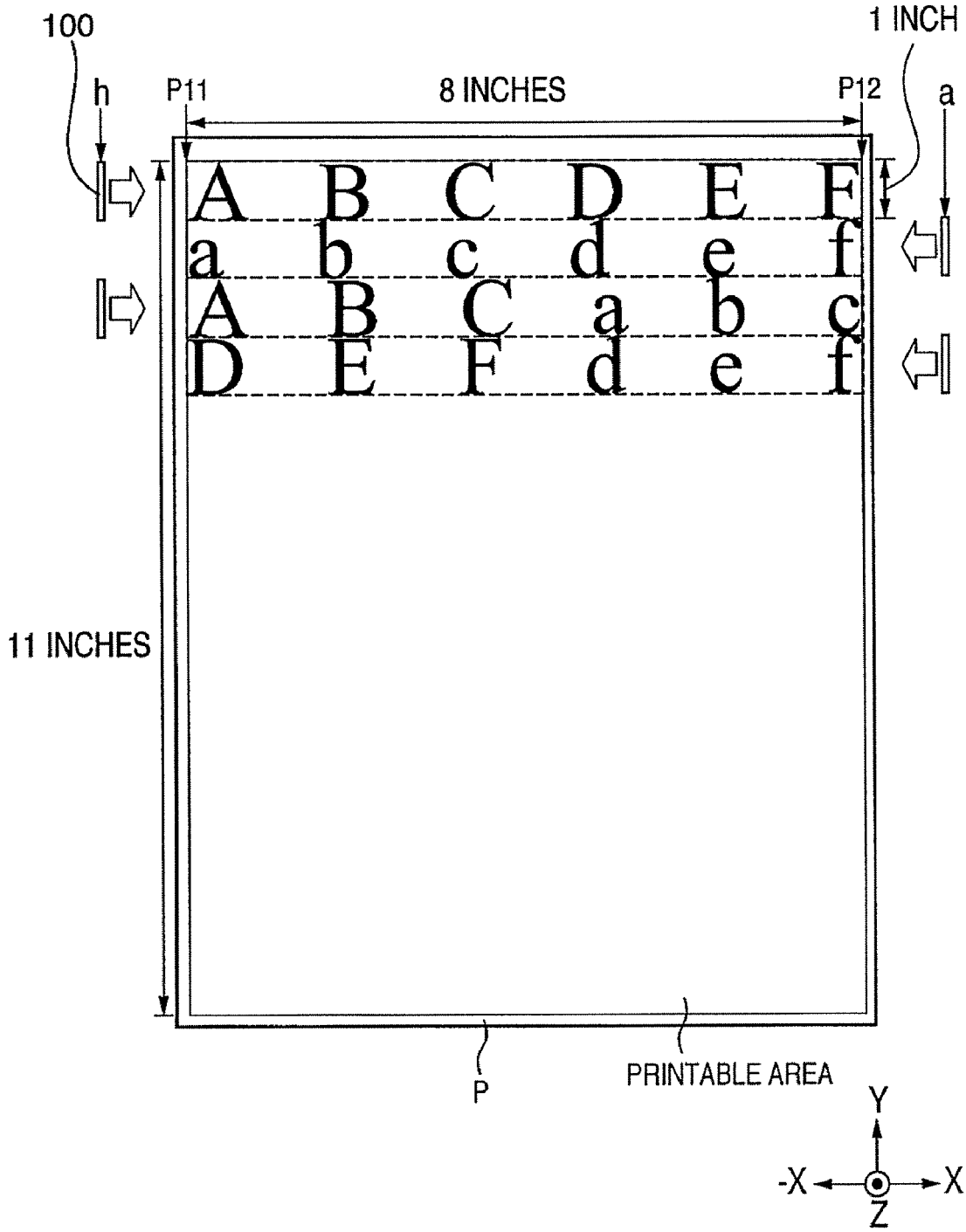
FIG. 4 is a view showing a state wherein a printhead 100 prints an image on a printing medium P using only black ink.

FIG. 4 is a view showing a state wherein a printhead 100 prints an image on a printing medium P using only black ink.

Referring to FIG. 4, the size of the printing medium P is A4. The hatched portion in FIG. 4 indicates a printable area (8 inches×11 inches). Symbol h indicates the home position of the printhead 100. As indicated by the hollow arrows, the printhead 100 executes forward direction printing twice and backward direction printing twice, that is, scans four times in total, thereby completing printing. In FIG. 4, P11 and P12 indicate left and right ends of the printable area, respectively, and a indicates a scanning direction change point of the printhead 100.

Figure 5:
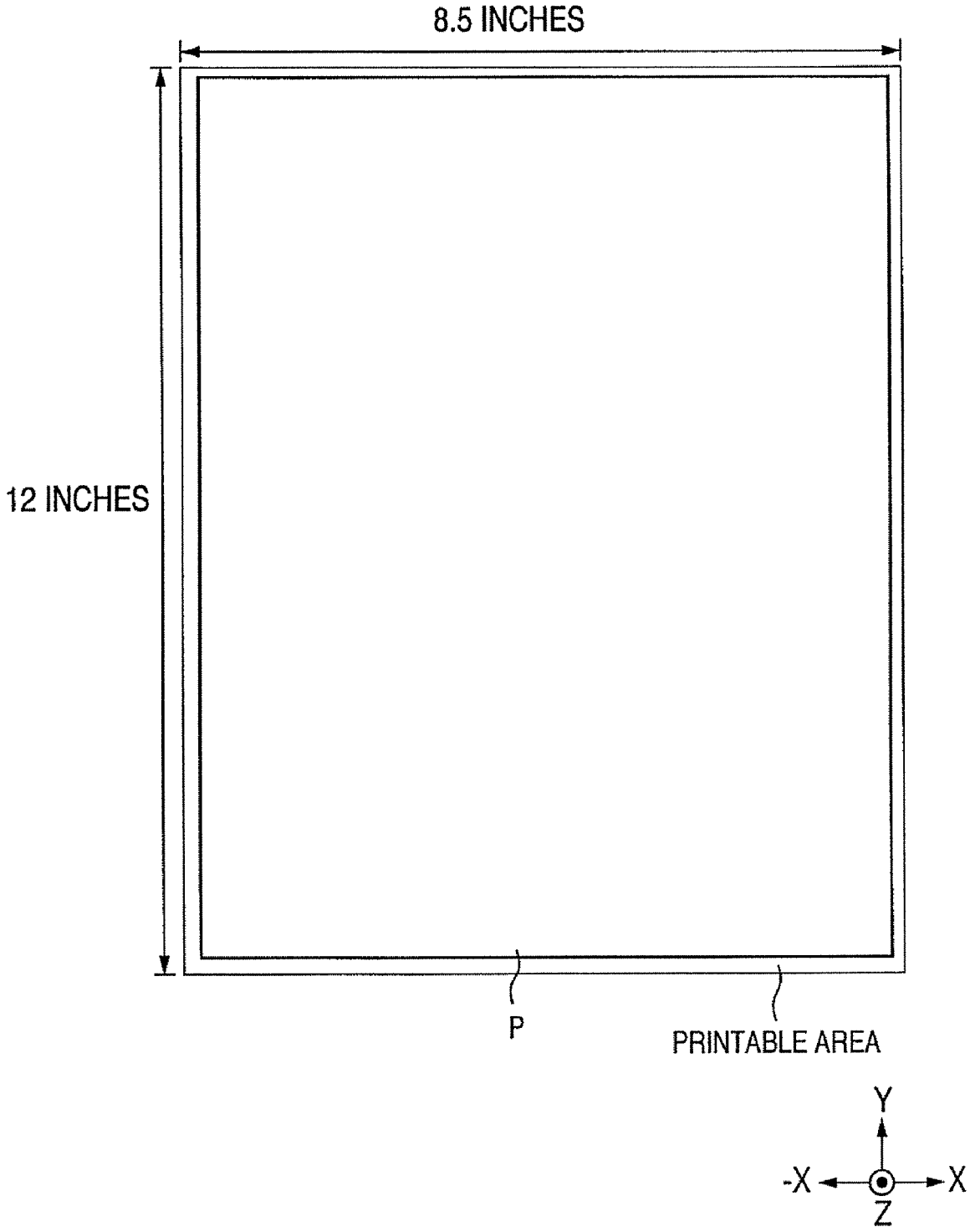
FIG. 5 is a view showing a state wherein the printhead 100 executes marginless printing on the printing medium P.

FIG. 4 shows a printable area set inside the printing medium P. The printing medium P has margins at its ends. However, printing may be performed throughout the printing medium P without forming margins at the ends of it, as shown in FIG. 5. In this case, the printable area is set to be larger than the printing medium P.

Figure 6:
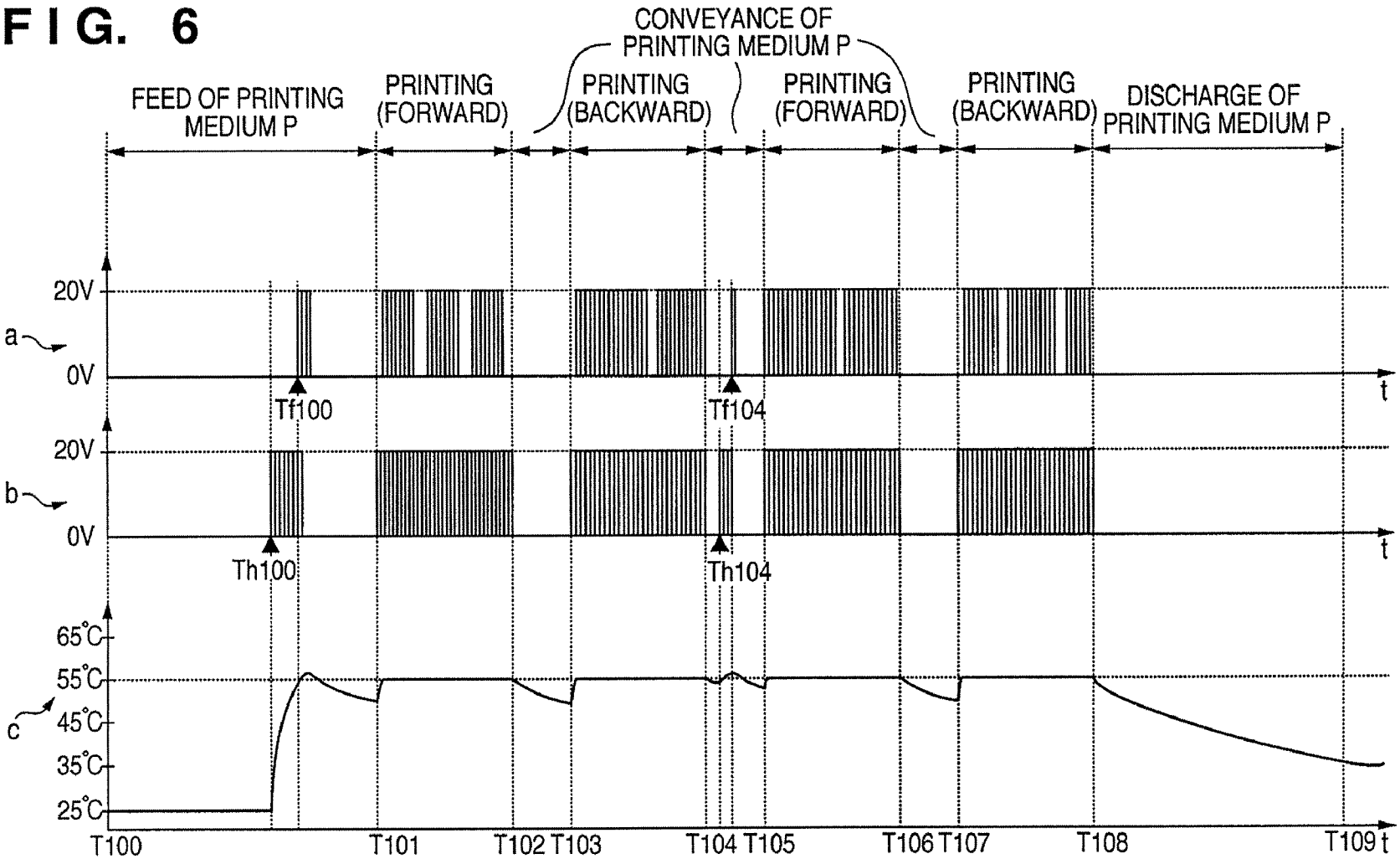
FIG. 6 is a timing chart showing head drive signal supply, sub-heater drive signal supply, and printhead temperature in a series of printing operations according to the first embodiment of the present invention.

FIG. 6 is a timing chart showing head drive signal supply, sub-heater drive signal supply, and printhead temperature in a series of printing operations. The series of printing operations includes feed of the printing medium P, start of printing, printing, end of printing, and discharge of the printing medium P.

Referring to FIG. 6, a indicates a timing chart of supply of a head drive signal to drive the heater 208. When the signal goes High (20 V), ink is discharged. In FIG. 6, b indicates a sub-heater drive signal to drive the sub-heater 207. When the signal goes High (20 V), the sub-heater 207 executes heating to raise the ink temperature. Stripe-like portions of a and b in FIG. 6 indicate that the signal levels High and Low are switched every 10 ns at the shortest.

In FIG. 6, c indicates a time variation in the printhead temperature which changes upon ink discharge and sub-heater heating. The values are obtained based on the output values from the thermistor 315 and diode sensor 203. As is apparent from c in FIG. 6, the ambient temperature before the start of the printing operation is 25° C.

The series of printing operations will be described next with reference to FIGS. 4 and 6.

First, at time (t) t=T100, feed of the printing medium P starts. After the printing medium is conveyed in the Y direction (sub-scanning direction) in FIG. 4 up to the upper end of the printable area, feed is ended at t=T101. The time from t=T100 to t=T101 is 1 sec.

At t=Tf100, preliminary discharge during feed (discharge in the non-printing state) starts to discharge 100 droplets from each orifice, thereby refreshing ink in the nozzles. At t=Th100 before t=Tf100, the sub-heater 207 starts heating. After heating is performed for 0.05 sec, the printhead temperature (HT) is measured. The temperature HT is compared with an adjustment temperature of 55° C. If HT≧55° C., the first temperature adjustment process finishes simultaneously with the start of preliminary discharge during feed at t=Tf100. In this way, the first temperature adjustment process is performed during the non-printing state before the start of printing. Note that the time necessary for preliminary discharge during feed is 100 (discharged droplets)/24 (kHz)=about 4.2 msec.

After the end of preliminary discharge during feed, the printhead temperature increased upon sub-heater heating and ink discharge of preliminary discharge gradually decreases to the equilibrium state (25° C.).

When feed is ended at t=T101, the printhead 100 located at the home position h moves in the X direction (main scanning direction). The first forward direction printing is executed from t=T101 when the printhead 100 reaches the left end P11 of the printable area to t=T102 when the printhead reaches the right end P12 of the printable area. Since the print scanning speed is 20 inches/sec, the time from t=T101 to t=T102 in which the printhead 100 scans the printable area is 8 (inches) 34 20 (inches/sec)=0.4 sec.

The second temperature adjustment process starts at t=T101 and finishes at t=T102. In the second temperature adjustment process, the sub-heater 207 is not driven during ink discharge. The sub-heater 207 is driven during ink non-discharge to adjust the printhead temperature to 55° C.

According to the temperature change indicated by c in FIG. 6, the printhead temperature is slightly lower than 55° C. immediately after t=T101. However, it is still equal to or higher than 45° C. which guarantees ink discharge and stays at 55° C. immediately thereafter. For this reason, the image quality rarely degrades immediately after the start of printing. After the end of the first forward direction printing, the printing medium P is conveyed by 1 inch, which is the orifice array width of the printhead 100, from t=T102 to t=T103 to prepare for the first backward direction printing. The time from t=T102 to t=T103 is 0.1 sec. During this time, neither ink discharge nor sub-heater heating is performed, and the printhead temperature gradually decreases.

Next, the printhead 100 moves from the scanning direction change point a to the home position h. The first backward direction printing is executed from t=T103 when the printhead 100 reaches the right end P12 of the printable area to t=T104 when the printhead reaches the left end P11 of the printable area. The time from t=T103 to t=T104 in which the printhead 100 scans the printable area in the backward direction is 0.4 sec, as in forward direction printing.

The third temperature adjustment process starts at t=T103 and finishes at t=T104. In the third temperature adjustment process, the sub-heater 207 is driven in accordance with discharge/non-discharge of ink, as in the first forward direction printing. The adjustment temperature of the printhead temperature at this time is also 55° C.

When the backward direction printing is ended, the printing medium P is conveyed in the Y direction by 1 inch, which is the orifice array width of the printhead 100, during 0.1 sec from t=T104 to t=T105. During this conveyance operation, preliminary discharge during printing (discharge in the non-printing state) is executed at t=Tf104 to discharge 10 droplets from each orifice, thereby refreshing ink in the nozzles.

In the non-printing state from t=T104 to t=T105, the fourth temperature adjustment process is executed. More specifically, at t=Th104 before t=Tf104, the sub-heater 207 is driven for 0.01 sec. Then, the printhead temperature (HT) is measured and compared with the adjustment temperature of 55° C. If HT≧55° C., the fourth temperature adjustment process finishes simultaneously with the start of preliminary discharge during printing at t=Tf104. The time of preliminary discharge during printing is 10 (discharged droplets)/24 (kHz)=about 0.42 msec.

After that, from t=T105 to t=T108, the second forward direction printing, conveyance of the printing medium P, and the second backward direction printing are performed, like from t=T101 to t=T104. When the second backward direction printing is ended, no more print data exists. At t=T108, discharge of the printing medium P starts. At t=T109 after 1 sec, paper discharge is completed, and the series of printing operations is ended.

In the above printing operations, the temperature adjustment process is executed four times. The first and fourth temperature adjustment processes are the same process executed in the non-printing state and are defined as a first-class temperature adjustment process. On the other hand, the second and third temperature adjustment processes are the same process executed in the printing state and are defined as a second-class temperature adjustment process.

According to this embodiment, in the first-class temperature adjustment process, drive of the sub-heater starts at a timing earlier than the execution timing of the preparation operation such as preliminary discharge during feed or preliminary discharge during printing, which is performed in the non-printing state to prepare for printing, thereby adjusting the printhead temperature to 55° C. This enables preliminary discharge with high recovery stability and also reduces extra ink discharge as compared to an operation without temperature adjustment.

Preliminary discharge aims at refreshing the internal state of the nozzles of the printhead by discharging ink and therefore requires no accurate temperature adjustment, unlike in the printing state, though the temperature needs to be at a level for ensuring reliable ink discharge. If the printhead is already heated to the reference temperature before the start of printing, as in Japanese Patent Laid-Open No. 6-278291, the temperature for ensuring ink discharge is obtained, and the object of the preliminary discharge can be achieved. However, if heating is always continued to maintain the high ink temperature in the non-printing state before the start of printing, the power consumption increases.

Figure 7A:
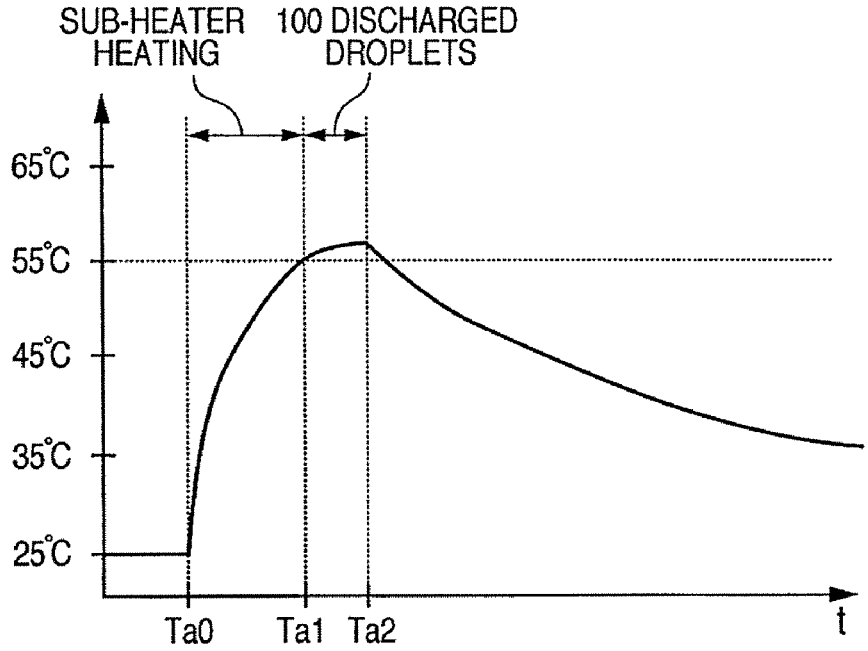
FIGS. 7A and 7B are graphs showing changes in the printhead temperature during preliminary discharge.
Figure 7B:
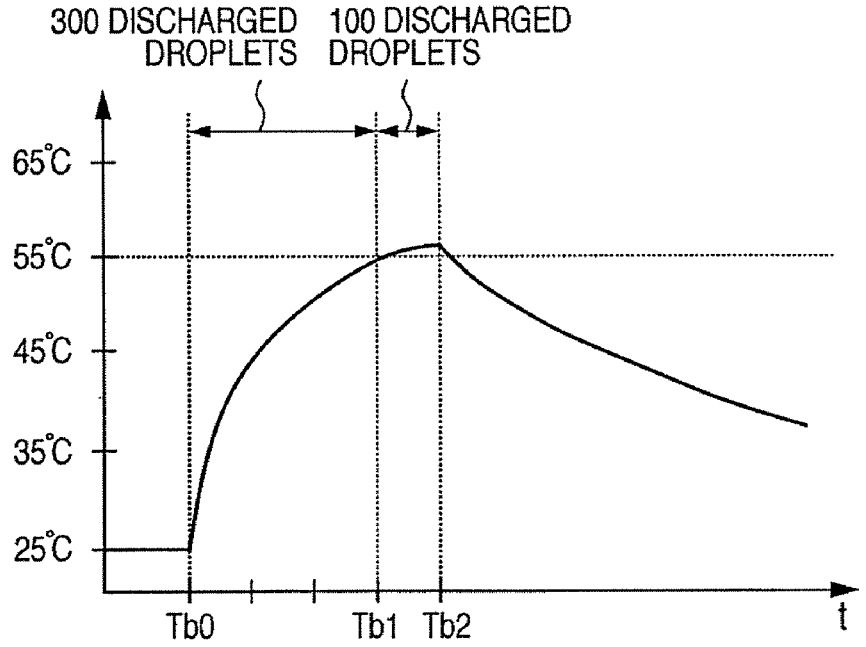

FIGS. 7A and 7B are graphs showing changes in the printhead temperature during preliminary discharge.

FIG. 7A shows a change in the printhead temperature when preliminary discharge with the temperature adjustment process of this embodiment is executed. FIG. 7B shows a comparative example without temperature adjustment.

For stable ink discharge, the temperature HT is optimally 55° C. In this embodiment, drive of the sub-heater 207 starts at t=Ta0 before t=Ta1 of the start of preliminary discharge and finishes at t=Ta1 when HT reaches 55° C., as shown in FIG. 7A. Preliminary discharge starts immediately after the end of sub-heater drive and finishes at t=Ta2.

In the comparative example without temperature adjustment, the printhead temperature can be raised only by driving the heaters 208 and discharging ink, as shown in FIG. 7B. To increase the printhead temperature by ink discharge, preliminary discharge starts at t=Tb0 and finishes at t=Tb2. The first discharge of 300 ink droplets at the start of preliminary discharge is utilized only to raise the printhead temperature. The number of ink droplets discharged to refresh the ink is 100. These ink droplets are discharged after t=Tb1 when the printhead temperature actually reaches 55° C.

Without temperature adjustment, a total of 400 ink droplets need to be discharged to reliably achieve the purpose of refreshing the ink. However, when temperature adjustment by sub-heater heating is performed, as in this embodiment, the number of ink droplets discharged in preliminary discharge can be reduced to 100.

As described above, according to this embodiment, even ink discharge (to be referred to as preliminary discharge hereinafter) which is periodically executed for a portion other than a printing medium in the non-printing state such as before the start of printing, during printing medium conveyance, and after the end of printing can stably be executed at lower power consumption.

In this embodiment, in the non-printing state after the first-class temperature adjustment process, the temperature adjustment process is not executed. The second-class temperature adjustment process starts simultaneously with the arrival of the printhead at the printable area. In the second-class temperature adjustment process, the printhead temperature is adjusted to the adjustment temperature of 55° C. during the period when the printhead is moving on the printable area (time t=T101 to T102, T103 to T104, T105 to T106, and T107 to T108). That is, the variations in the amount of ink discharge and discharge speed caused by the variation in the printhead temperature decrease, as compared to the method of always adjusting the printhead temperature from the non-printing state before the start of printing. This makes it possible to suppress occurrence of density unevenness and reduce the energy consumed by printhead temperature adjustment.

Figure 8:
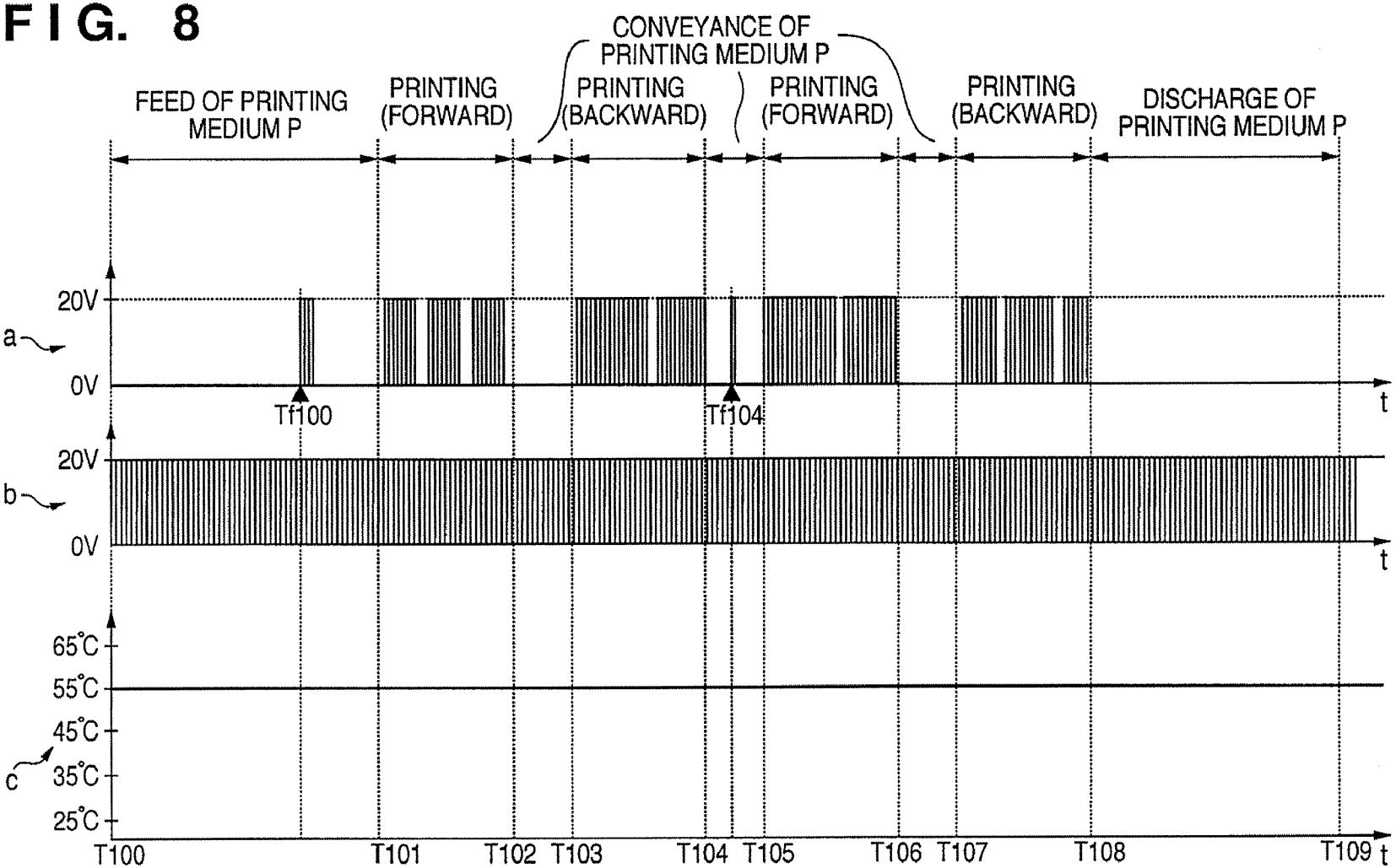
FIG. 8 is a timing chart showing head drive signal supply, sub-heater drive signal supply, and printhead temperature in a series of printing operations in always adjusting the temperature.

FIG. 8 is a timing chart showing head drive signal supply, sub-heater drive signal supply, and printhead temperature in a series of printing operations in always adjusting the temperature from the non-printing state before the start of printing. The series of printing operations shown in FIG. 8 is the same as that described with reference to FIGS. 4 and 6. FIG. 8 shows a comparative example to FIG. 6. Hence, a, b, and c in FIG. 8 correspond to a, b, and c in FIG. 6, respectively, and a in FIG. 6 is the same as a in FIG. 8. The continuous temperature adjustment that starts before the start of printing in FIG. 8 is performed to always maintain the printhead temperature (HT) at 55° C. to stably discharge ink. According to this method, the printhead temperature is measured at a predetermined interval (e.g., every 0.01 sec). If HT<55° C., the sub-heater 207 is driven. If HT≧55° C., the sub-heater 207 is not driven.

According to c in FIG. 8, since the printhead temperature remains at 55° C. during printing and printing medium conveyance, density unevenness in a printed image can be suppressed. However, as is apparent from comparison between b in FIG. 6 and b in FIG. 8, if continuous temperature adjustment is performed to achieve the object of maintaining a predetermined printhead temperature during printing, the power consumption by sub-heater heating increases.

According to this embodiment, printing can be performed while suppressing occurrence of density unevenness even immediately after the start of printing at a power consumption of about 60% of that in the comparative example of continuous temperature adjustment.

In the above-described embodiment, the first-class temperature adjustment process and second-class temperature adjustment process are implemented by driving the sub-heater. However, the present invention is not limited to this. For example, temperature adjustment may be implemented by supplying, to the ink discharge heaters, energy at a level that does not cause ink discharge. Alternatively, temperature adjustment may be implemented by combining the heaters and sub-heater.

The number of times of printhead drive abruptly increases depending on print data. Hence, even when the second-class temperature adjustment process is executed during printing, it may be difficult to maintain a predetermined printhead temperature. If the printhead temperature during printing varies, density unevenness may occur in an image printed on a printing medium. To prevent this, the second-class temperature adjustment and PWM control (see Japanese Patent Laid-Open No. 5-92565) capable of controlling the amount of ink discharge are preferably used together.

PWM control is a technique of holding a predetermined amount of ink discharge, with respect to a heat pulse divided into a prepulse and a main pulse, by changing the prepulse width in accordance with the printhead temperature. Even when the number of times of printhead heater drive largely varies during printing, occurrence of density unevenness can be suppressed by executing the printhead temperature adjustment process and PWM control together.

Second Embodiment

A temperature retaining control method according to the second embodiment is executed by a first-class temperature adjustment process which ensures ink discharge stability with lower power consumption and a second-class temperature adjustment process capable of further suppressing occurrence of density unevenness, as compared to the first embodiment.

In the second embodiment, the same reference numerals as in the first embodiment denote the same components already described above, and a description thereof will be omitted. Even in this embodiment, printing shown in FIG. 4 is executed, as in the first embodiment.

Figure 9:
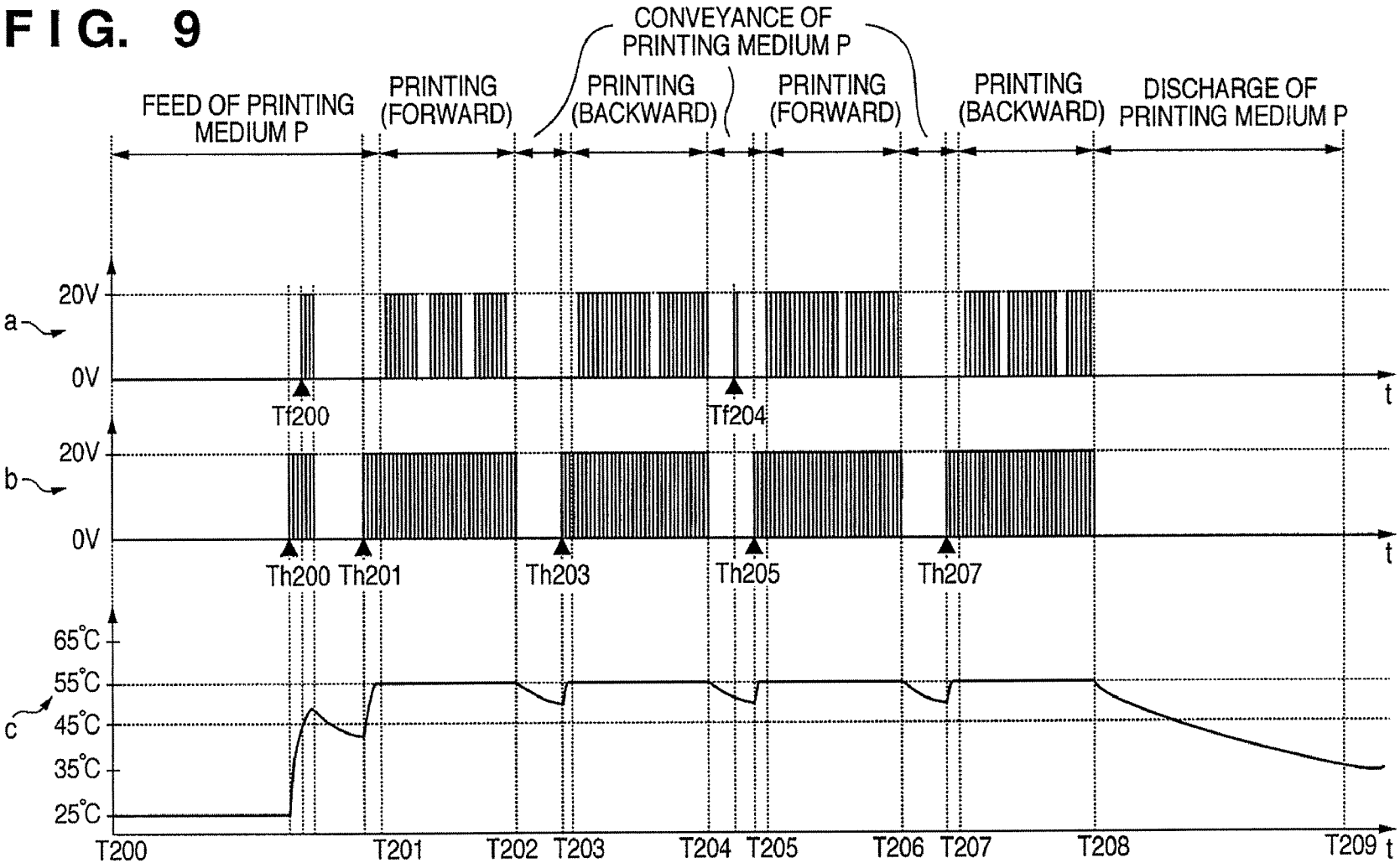
FIG. 9 is a timing chart showing head drive signal supply, sub-heater drive signal supply, and a change in the printhead temperature in a series of printing operations according to the second embodiment of the present invention.

FIG. 9 is a timing chart showing head drive signal supply, sub-heater drive signal supply, and a change in the printhead temperature in a series of printing operations according to this embodiment.

FIG. 9 shows a, b, and c corresponding to the contents of a, b, and c in FIG. 6, respectively. The ambient temperature before the start of printing operation is 25° C., as in the first embodiment.

At time t=T200, feed of a printing medium P starts. After the printing medium is conveyed in the Y direction (sub-scanning direction) in FIG. 4 up to the upper end of the printable area, feed is ended at t=T201. The time from t=T200 to t=T201 is 1 sec.

The printhead temperature need not always be 55° C. Preliminary discharge is possible at 45° C. or more. Hence, at t=Th200, the first-class temperature adjustment process starts. A sub-heater 207 is driven to execute sub-heater heating for 0.02 sec, thereby adjusting the printhead temperature to 45° C. At t=Tf200 when the printhead temperature reaches 45° C., preliminary discharge during feed starts. However, if the number of discharged ink droplets per unit time in the preliminary discharge during feed is extremely small, the printhead temperature can drop during execution of preliminary discharge until HT≦45° C. To prevent this, in this embodiment, the sub-heater 207 is continuously driven even after the start of preliminary discharge during feed. The drive finishes simultaneously with the end of preliminary discharge. The time necessary for preliminary discharge during feed is 100 (discharged droplets)/24 (kHz)=about 4.2 msec.

After the end of preliminary discharge during feed, the printhead temperature increased upon sub-heater heating and ink discharge of preliminary discharge gradually decreases to the equilibrium state (25° C.).

When feed is ended at t=T201, the first forward direction printing is executed from t=T201 to t=T202, as in the first embodiment.

The second-class temperature adjustment process starts at t=Th201 0.05 sec before t=T201 of the start of forward direction printing and finishes at t=T202 when a printhead 100 reaches a right end P12 of the printable area. This process is executed to satisfy the optimum printhead temperature of 55° C. for printing when the printhead 100 reaches the printable area. The second-class temperature adjustment process executed from t=Th201 to t=T202 is the same as that described in the first embodiment.

After the end of the first forward direction printing, the printing medium P is conveyed from t=T202 to t=T203 to prepare for the next printing. The time from t=T202 to t=T203 is 0.1 sec. During this time, neither ink discharge nor sub-heater heating is performed, and the printhead temperature gradually decreases.

From t=T203 to t=T204, the first backward direction printing is executed, as in the first embodiment.

The second-class temperature adjustment process starts at t=Th203 0.05 sec before t=T203 of the start of backward direction printing and finishes at t=T204 when the printhead 100 reaches a left end P11 of the printable area. This process is executed to satisfy the optimum printhead temperature of 55° C. for printing when the printhead 100 reaches the printable area. The second-class temperature adjustment process executed from t=Th203 to t=T204 is the same as that described in the first embodiment.

After the end of the first backward direction printing, the printing medium P is conveyed from t=T204 to t=T205 to prepare for the next printing.

Preliminary discharge during printing (discharge in the non-printing state) is executed at t=Tf204 between t=T204 and t=T205 to discharge 10 ink droplets from each orifice of the printhead, thereby refreshing ink in the nozzles. The first-class temperature adjustment process is normally executed here to adjust the printhead temperature to 45° C. However, according to the printhead temperature indicated by c in FIG. 9, the printhead temperature before the preliminary discharge during printing is 48° C. For this reason, in this embodiment, only the preliminary discharge during printing is executed without executing the first-class temperature adjustment process. The execution time of preliminary discharge during printing is 10 (discharged droplets)/24 (kHz)=about 0.42 msec.

After that, from t=T205 to t=T208, the second forward direction printing, conveyance of the printing medium P, and the second backward direction printing are performed, like from t=T201 to t=T204. When the second backward direction printing is ended, discharge of the printing medium P starts at t=T208. At t=T209 after 1 sec. paper discharge is completed, and the printing operation is ended.

According to this embodiment, the first-class temperature adjustment process is executed to adjust the printhead temperature to 45° C. for preliminary discharge during feed or preliminary discharge during printing executed during feed or conveyance of the printing medium P. This makes the number of opportunities of printhead heating smaller than that in the first embodiment, and enables preliminary discharge with high recovery stability while reducing the power consumption.

In this embodiment, in the non-printing state after the first-class temperature adjustment process, the temperature adjustment process is not executed. The second-class temperature adjustment process starts before the printhead reaches the printable area. The printhead temperature is adjusted to 55° C. during the period when the printhead is scanning over the printable area (time t=T201 to T202, T203 to T204, T205 to T206, and T207 to T208). The printhead temperature never becomes lower than 55° C. immediately after the start of printing, unlike in the first embodiment. It is therefore possible to further suppress the variations in the amount of ink discharge and discharge speed depending on the printhead temperature and suppress occurrence of density unevenness.

In this embodiment, the adjustment temperature in the first-class temperature adjustment process is 45° C. in both preliminary discharge during feed and preliminary discharge during printing. However, the present invention is not limited to this. For example, in preliminary discharge after the printhead is left for a long time, the degree of increase in ink viscosity or solidification is expected to be high. Hence, to make the ink easier to discharge, the adjustment temperature may be set to a high temperature of, for example, 65° C. only in preliminary discharge during feed.

Third Embodiment

In this embodiment, a temperature retaining control method for printing in a low-temperature environment where the ambient temperature is, for example, 10° C. will be described. In the third embodiment, the same reference numerals as in the first and second embodiments denote the same components already described above, and a description thereof will be omitted.

Figure 10:
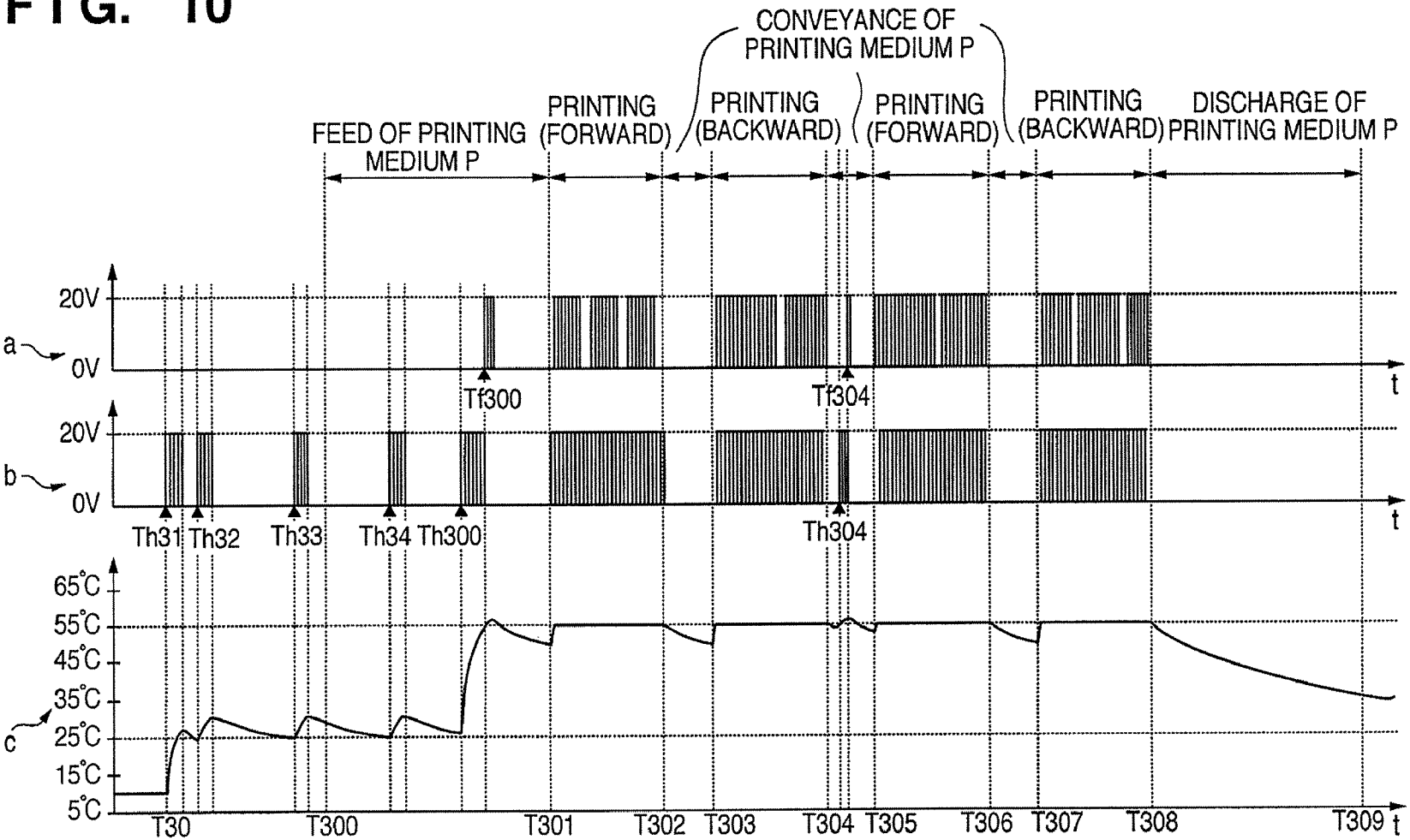
FIG. 10 is a timing chart showing head drive signal supply, sub-heater drive signal supply, and a change in the printhead temperature in a series of printing operations according to the third embodiment of the present invention.

FIG. 10 is a timing chart showing head drive signal supply, sub-heater drive signal supply, and a change in the printhead temperature in a series of printing operations according to this embodiment.

FIG. 10 shows a, b, and c corresponding to the contents of a, b, and c in FIG. 6, respectively. In this embodiment, the ambient temperature before the start of printing operation is 10° C.

First, at time t=T30, print data is received from a host apparatus, and a cap 312 of a printhead 100 is removed. When the cap 312 is removed, a third-class temperature adjustment process starts, unlike the first and second embodiments. The third-class temperature adjustment process is a process executed when the printing apparatus is in a low-temperature environment. In the third-class temperature adjustment process, the printhead temperature is compared with the adjustment temperature (25° C.) of the third-class temperature adjustment process. If the printhead temperature is lower than the adjustment temperature, the printhead temperature is adjusted to 25° C.

The printhead temperature immediately after the cap 312 is removed can be presumed to be 10° C. equal to the ambient temperature. This temperature is lower than the adjustment temperature (25° C.) of the third-class temperature adjustment process. For this reason, the third-class temperature adjustment process is executed to drive a sub-heater 207 for 0.05 sec at t=Th31. In this case, the printhead temperature rises to 27° C. by the process, as indicated by c in FIG. 10.

The printhead temperature (HT) is always measured at a predetermined interval (e.g., every 0.1 sec), and the measured temperature is compared with the adjustment temperature. If it is determined based on the comparison result that HT≧adjustment temperature (25° C.), drive of the sub-heater 207 stops. Then, the printhead temperature gradually decreases to the equilibrium state (10° C.), as indicated by c in FIG. 10. Even after that, the measured printhead temperature is compared with the adjustment temperature. If it is determined at t=Th32 that HT<25° C., the sub-heater heating of the third-class temperature adjustment process is executed again, and the sub-heater 207 is driven for 0.05 sec.

At t=T300, feed of a printing medium P starts. However, the third-class temperature adjustment process continues, and the above-described printhead temperature measurement, comparison with the adjustment temperature, and sub-heater heating are repeated until the first-class temperature adjustment process starts at t=Th300. Hence, the sub-heater 207 is driven for 0.05 sec at t=Th33 and t=Th34 when HT<25° C., thereby always adjusting the printhead temperature to 25° C. or more, as indicated by b and c in FIG. 10.

At t=Tf300, preliminary discharge during feed (discharge in the non-printing state) which is the same as the preliminary discharge executed at t=Tf100 in the first embodiment starts. The first-class temperature adjustment process starts at t=Th300 before t=Tf300 and finishes at t=Tf300.

In the non-printing state from the end of preliminary discharge during feed to t=T301 when feed finishes, the printhead temperature decreases because ink discharge is not performed. However, the temperature still remains in a range from 57° C. to 49° C. and maintains at least the adjustment temperature (25° C.) of the third-class temperature adjustment process or more. For this reason, temperature adjustment by sub-heater heating of the third-class temperature adjustment process is not executed.

The printing operation from t=T301 is the same as in the first embodiment. The second-class temperature adjustment process is executed during periods of t=T301 to T302, T303 to T304, T305 to T306, and T307 to T308. From t=Th304 to t=Tf304, the first-class temperature adjustment process is executed.

According to the change in the printhead temperature indicated by c in FIG. 10, the printhead temperature never becomes lower than 25° C. from t=T301 onward. Hence, the third-class temperature adjustment process is no longer executed.

Figure 11A:
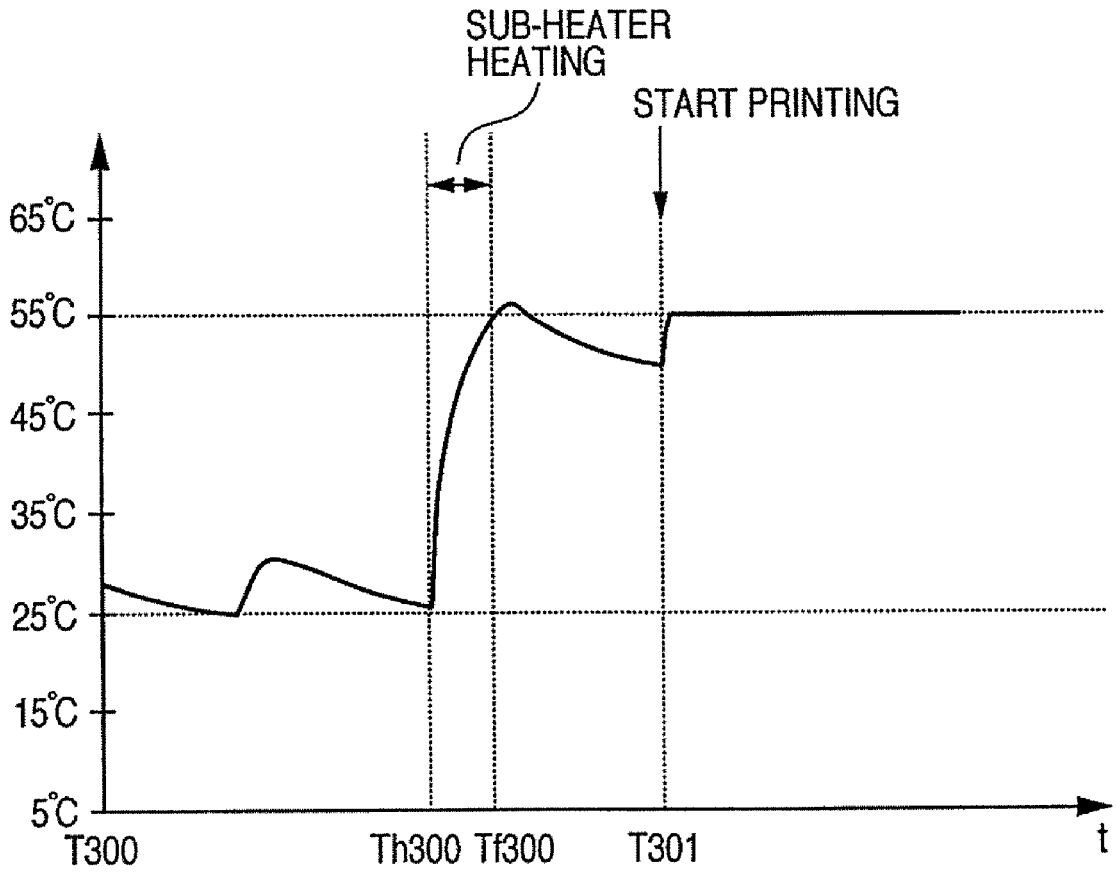
FIGS. 11A and 11B are graphs showing changes in the printhead temperature from printing medium feed to the start of printing in a low-temperature environment.
Figure 11B:
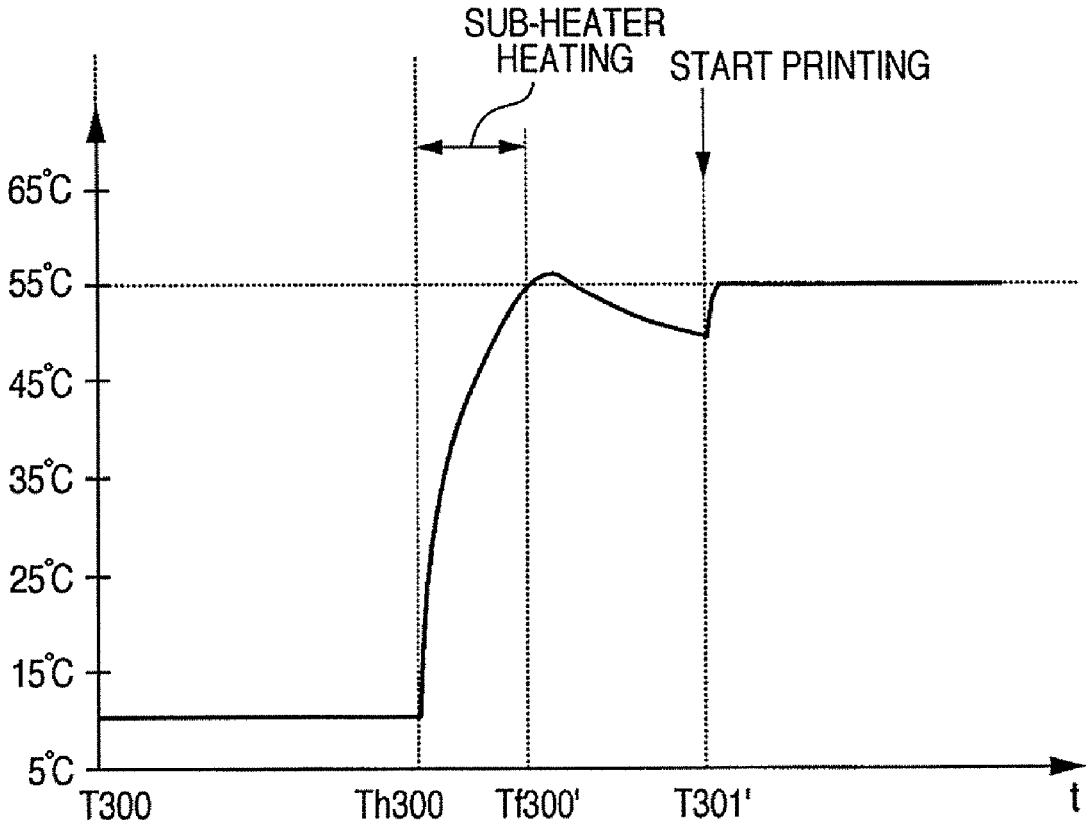

FIGS. 11A and 11B are graphs showing changes in the printhead temperature from printing medium feed to the start of printing in a low-temperature environment.

FIG. 11A shows a change in the printhead temperature when temperature retaining control of this embodiment is executed. FIG. 11B shows a comparative example of a change in the printhead temperature without temperature retaining control.

FIGS. 11A and 11B are compared. At the start time t=T300 of feed and the start time t=Th300 of sub-heater drive by the first-class temperature adjustment process, the printhead temperature in FIG. 11A is equal to that in FIG. 11B. However, if the input energy of sub-heater heating per unit time does not change, the time until the printhead temperature reaches 55° C. is longer in starting the first-class temperature adjustment process from the ambient temperature of 10° C. than in starting the first-class temperature adjustment process from the ambient temperature of 25° C. That is, since Tf300−Th300<Tf300'−Th300, the printing start time delays. For this reason, if the first-class temperature adjustment process starts by sub-heater heating in the low-temperature environment without the third-class temperature adjustment process described in this embodiment, the throughput deteriorates.

However, according to this embodiment, since the third-class temperature adjustment process is executed to adjust the printhead temperature to 25° C. or more before the first-class temperature adjustment process, no long-time sub-heater heating is necessary in the first-class temperature adjustment process. For this reason, even in the low-temperature environment with an ambient temperature of, for example, 10° C., it is possible to perform printing at the same throughput as for the normal ambient temperature (e.g. 25° C.).

According to the above-described embodiment, preliminary discharge with high recovery stability can be executed without deteriorating the throughput even in a low-temperature environment by adjusting the printhead temperature to 25° C. or more even in the non-printing state without ink discharge.

When the printing apparatus is installed at a normal temperature of about 25° C., sub-heater heating by the third-class temperature adjustment process can be inhibited by setting the adjustment temperature of the third-class temperature adjustment process to 25° C. or less. In this case, a temperature retaining control method with the same arrangement as described in the first embodiment can be employed.

Fourth Embodiment

In this embodiment, a temperature retaining control method optimum when print data in the main scanning direction is smaller than the printable area will be described. In the fourth embodiment, the same reference numerals as in the first, second, and third embodiments denote the same components already described above, and a description thereof will be omitted.

Figure 12:
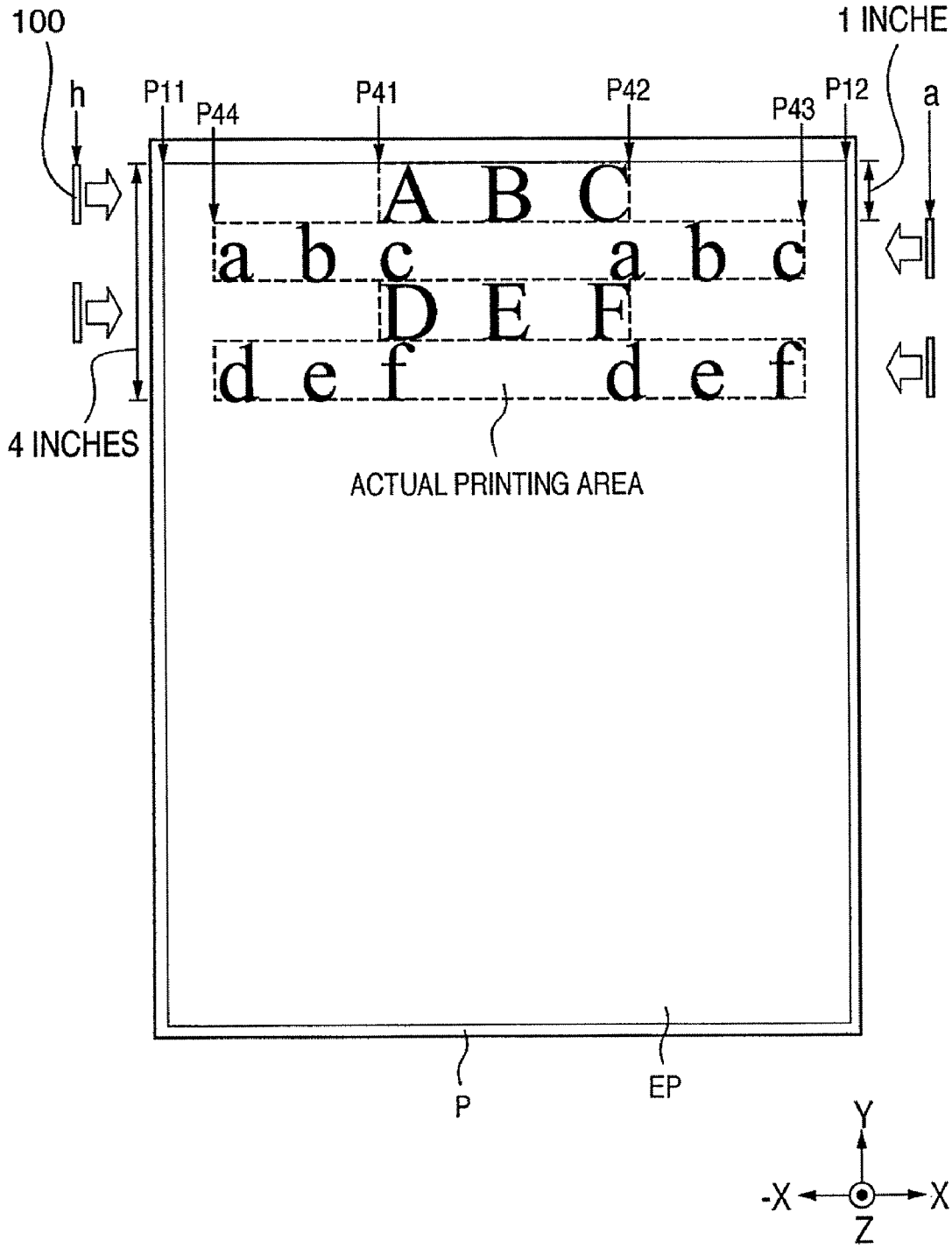
FIG. 12 is a view showing a state wherein a printhead 100 prints an image on a printing medium P using only black ink according to the fourth embodiment of the present invention.

FIG. 12 is a view showing a state wherein a printhead 100 prints an image on a printing medium P using only black ink.

Referring to FIG. 12, the size of the printing medium P is A4. EP represents a printable area. In printing shown in FIG. 12, the printhead 100 executes forward direction printing twice and backward direction printing twice, that is, scans four times in total, thereby completing printing, as indicated by the hollow arrows. In FIG. 12, P41 and P42 indicate left and right ends of the print data area in the first forward direction printing, respectively. P43 and P44 indicate left and right ends of the print data area in the first backward direction printing, respectively.

Figure 13:
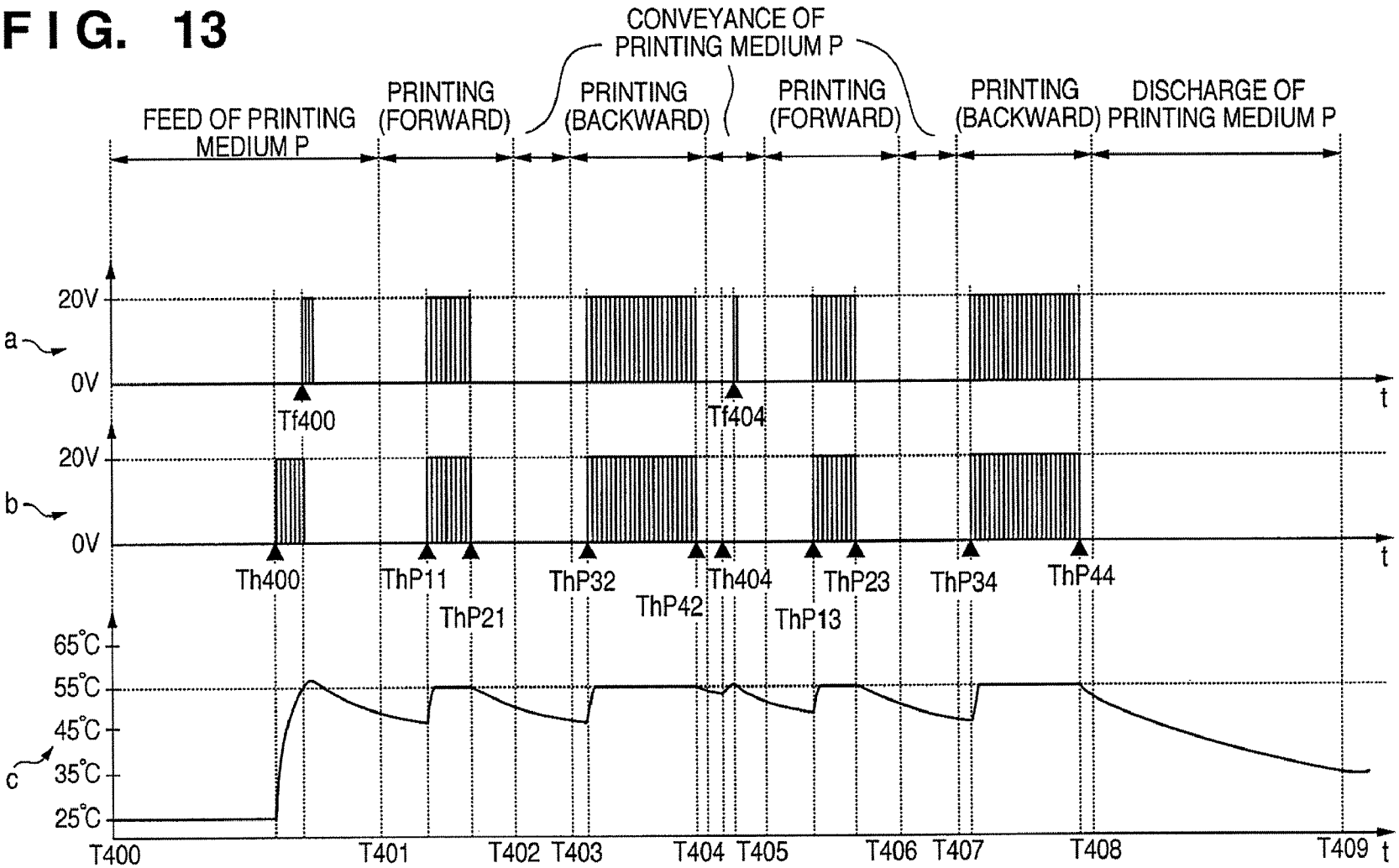
FIG. 13 is a timing chart showing head drive signal supply, sub-heater drive signal supply, and a change in the printhead temperature in a series of printing operations according to the fourth embodiment of the present invention.

FIG. 13 is a timing chart showing head drive signal supply, sub-heater drive signal supply, and a change in the printhead temperature in a series of printing operations according to this embodiment.

FIG. 13 shows a, b, and c corresponding to the contents of a, b, and c in FIG. 6, respectively. The ambient temperature before the start of printing operation is 25° C., as in the first and second embodiments.

At time t=T400, feed of the printing medium P starts. After the printing medium is conveyed up to the upper end of the printable area shown in FIG. 12, feed is ended at t=T401. The time from t=T400 to t=401 is 1 sec. At t=Tf400, preliminary discharge during feed as in the first embodiment starts to refresh ink in the nozzles. At t=Th400 before t=Tf400, the first-class temperature adjustment process starts to drive a sub-heater 207 so that sub-heater heating is performed for 0.05 sec. After that, the printhead temperature (HT) is measured. The measured temperature is compared with an adjustment temperature (55° C.) . If HT≧55° C., the first-class temperature adjustment process finishes simultaneously with the start of preliminary discharge during feed at t=Tf400.

Note that the time of preliminary discharge during feed is 100 (discharged droplets)/24 (kHz)=about 4.2 msec. After the end of preliminary discharge during feed, the printhead temperature increased upon sub-heater heating and ink discharge of preliminary discharge gradually decreases to the equilibrium state (25° C.).

When feed is ended at t=T401, the printhead 100 scans in the main scanning direction from a home position h to execute the first forward direction printing from the left end P11 of the printable area (t=T401) to the right end P12 of the printable area (t=T402). However, as is apparent from FIG. 12, printing is actually executed by discharging ink while the printhead 100 passes from the position P41 to the position P42. Note that the scan time of the printhead 100 from the left end P11 to the right end P12 of the printable area is 0.4 sec. and the scan time (t=ThP11 to ThP21) of the printhead 100 in the area from P41 to P42 with actual ink discharge is 0.2 sec.

In this embodiment, the second-class temperature adjustment process as in the first embodiment is executed from the time ThP11 when the printhead 100 reaches the position P41 of actual ink discharge to the time ThP21 when the printhead 100 reaches the position P42. According to the printhead temperature change indicated by c in FIG. 13, the printhead temperature is slightly lower than 55° C. immediately after t=ThP11. However, it is still equal to or higher than 45° C. that ensures ink discharge. The temperature rises and stays at 55° C. immediately after. For this reason, the printing quality rarely degrades immediately after the start of printing.

After the end of the first forward direction printing, the printing medium P is conveyed from t=T402 to t=T403 to prepare for the next printing. During this time, neither ink discharge nor sub-heater heating is performed, and the printhead temperature gradually decreases.

Next, the printhead 100 moves from a scanning direction change point a to the home position h. The first backward direction printing is executed from t=T403 when the printhead 100 reaches the right end P12 of the printable area to t=T404 when the printhead reaches the left end P11 of the printable area. However, actual ink discharge is performed while the printhead 100 passes from the position P43 to the position P44. Note that the scan time of the printhead 100 in the printable area in the backward direction printing is 0.4 sec, as in the forward direction printing. The scan time (t=ThP32 to ThP42) of the printhead 100 in the actual ink discharge area is 0.35 sec.

In the backward direction printing, the second-class temperature adjustment process as in the first embodiment is executed from the time (t=ThP32) when the printhead 100 reaches the position P43 of actual ink discharge to the time (t=ThP42) when the printhead 100 reaches the position P44.

When the backward direction printing is ended, the printing medium P is conveyed from t=T404 to t=T405. At t=Tf404 during the conveyance period, preliminary discharge during printing (discharge in the non-printing state) as in the first embodiment is executed to refresh ink in the nozzles. The time of preliminary discharge during printing is 10 (discharged droplets)/24 (kHz)=about 0.42 msec.

At t=Th404 before t=Tf404, the first-class temperature adjustment process starts to drive the sub-heater 207 for 0.01 sec. Then, the printhead temperature is measured. If HT≧55° C., the first-class temperature adjustment process finishes simultaneously with the start of preliminary discharge during printing at t=Tf404.

After that, from t=T405 to t=T408, the second forward direction printing, conveyance of the printing medium P, and the second backward direction printing are performed, like from t=T401 to t=T404.

In the second forward direction printing, the second-class temperature adjustment process is executed from time t=ThP13 to time t=ThP23 while the printhead 100 passes from the position P41 to the position P42. Similarly, in the second backward direction printing, the second-class temperature adjustment process is executed from time t=ThP34 to time t=ThP44 while the printhead 100 passes from the position P43 to the position P44. When the second backward direction printing is ended, discharge of the printing medium P starts at t=T408. At t=T409 after 1 sec, paper discharge is completed, and the printing operation is ended.

According to this embodiment, in a case where the printing area of actual ink discharge is smaller than the printable area, the temperature adjustment by the second-class temperature adjustment process starts simultaneously with the arrival of the printhead at the actual ink discharge area. Only when the printhead is passing through the ink discharge area (time t=ThP11 to ThP21, t=ThP32 to ThP42, t=ThP13 to ThP23, and t=ThP34 to ThP44), the printhead temperature is adjusted to 55° C. This enables printing with less occurrence of density unevenness with lower power consumption than in the first embodiment.

Figure 14:
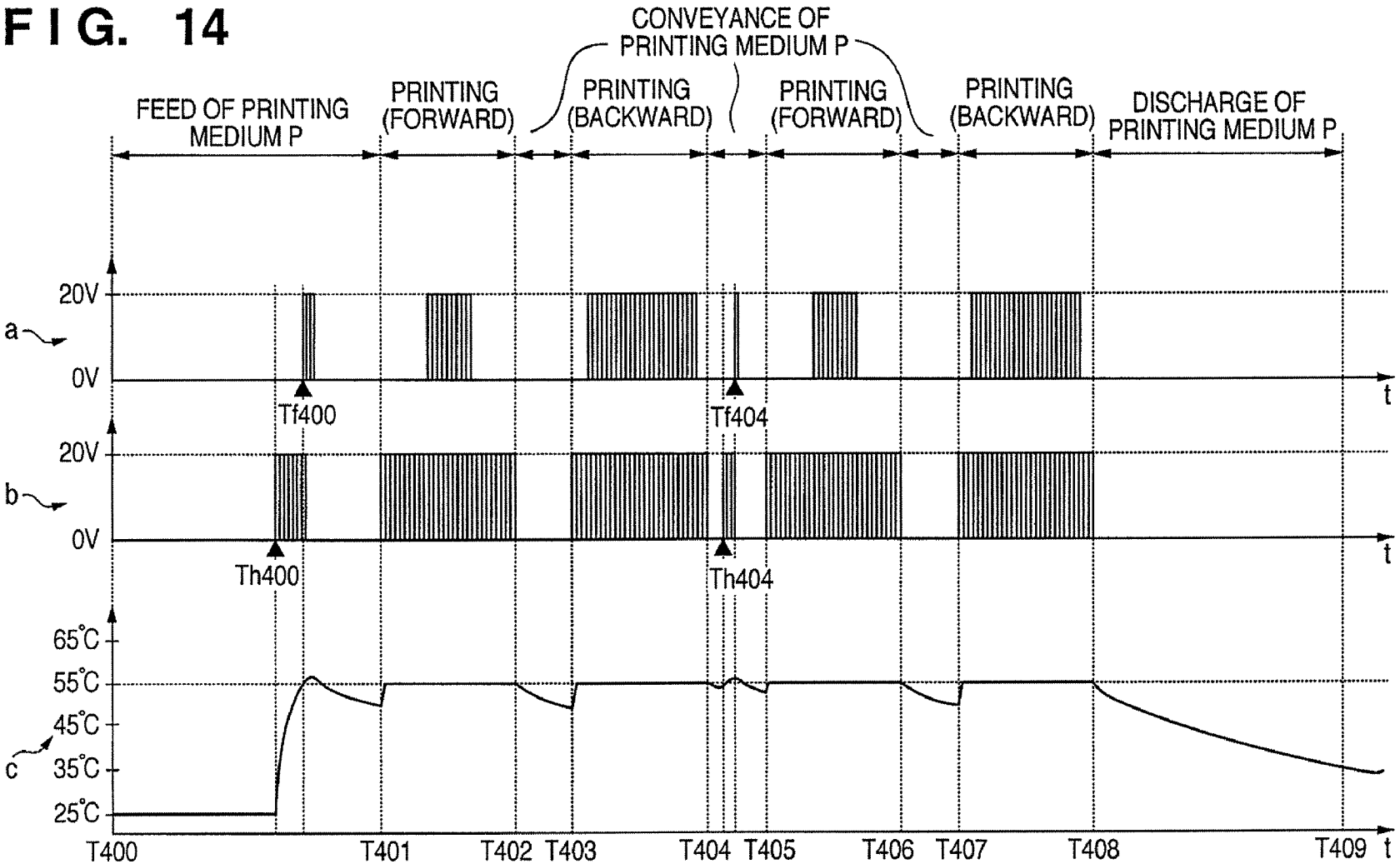
FIG. 14 is a timing chart showing head drive signal supply, sub-heater drive signal supply, and a change in the printhead temperature in a series of operations of printing the image shown in FIG. 12 as a comparative example of the fourth embodiment.

FIG. 14 is a timing chart showing head drive signal supply, sub-heater drive signal supply, and a change in the printhead temperature when the image shown in FIG. 12 is printed by the temperature retaining control method according to the first embodiment as a comparative example of the fourth embodiment.

Hence, a, b, and c in FIG. 14 correspond to a, b, and c in FIG. 13, respectively. The ambient temperature before the start of the printing operation is 25° C., as in the fourth embodiment. The second-class temperature adjustment process in FIG. 14 is the same as the second-class temperature adjustment process of the first embodiment.

The description will be made below by comparing FIG. 14 with FIG. 13.

While the printhead 100 passes through the printing area with actual ink discharge (time t=ThP11 to ThP21, t=ThP32 to ThP42, t=ThP13 to ThP23, and t=ThP34 to ThP44), the printhead temperature almost stays at 55° C. in both cases. Since the amount of ink discharge and discharge speed do not vary due to the printhead temperature, printing can be performed satisfactorily while suppressing occurrence of density unevenness in both cases.

However, as is apparent from comparison between b in FIG. 13 and b in FIG. 14, the power consumption is large in the temperature retaining control method according to the first embodiment because the sub-heater 207 is always driven to maintain a predetermined printhead temperature during forward and backward direction printing. To the contrary, in the temperature retaining control method according to the fourth embodiment, the power consumption is about 50% that of the comparative example. That is, the fourth embodiment allows adjusting the printhead temperature during forward and backward direction printing with lower power consumption.

In this embodiment, the second-class temperature adjustment process starts simultaneously with the arrival of the printhead at the printing area with actual ink discharge. However, the present invention is not limited by the start timing of the second-class temperature adjustment process if the temperature adjustment process is not executed in the non-printing state after execution of the first-class temperature adjustment process. For example, when the second-class temperature adjustment process starts before the arrival of the printhead at the actual printing area, adjustment can be made such that the printhead temperature never becomes lower than 55° C. immediately after the arrival of the printhead at the actual printing area (immediately after time t=ThP11). Hence, even immediately after the start of printing, an image with high quality can be printed while suppressing occurrence of density unevenness.

Fifth Embodiment

Figure 15:
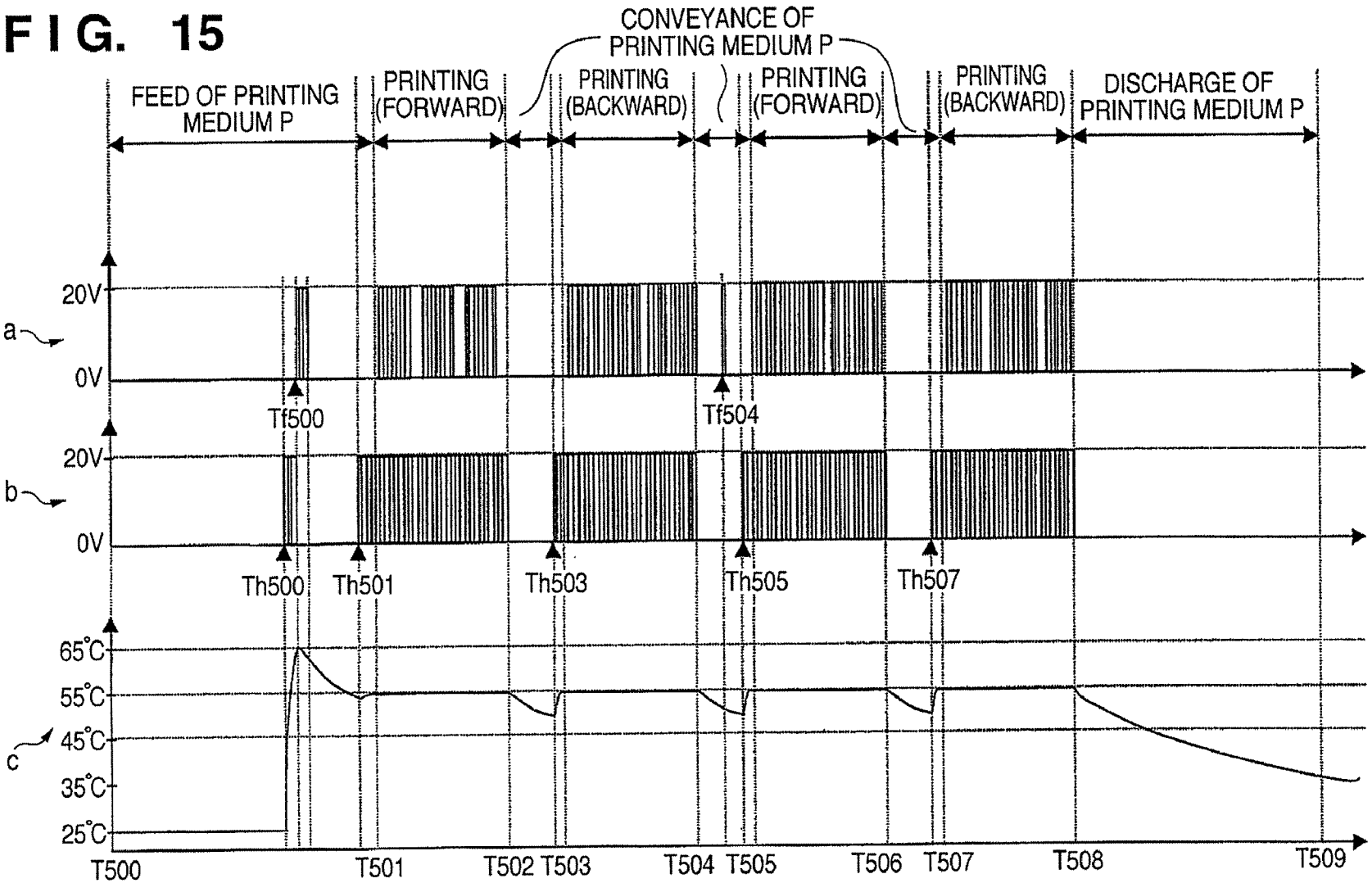
FIG. 15 is a timing chart showing head drive signal supply, sub-heater drive signal supply, and printhead temperature in a series of printing operations according to the fifth embodiment of the present invention.

FIG. 15 is a timing chart showing head drive signal supply, sub-heater drive signal supply, and printhead temperature in a series of printing operations according to this embodiment. The series of printing operations includes feed of a printing medium P, start of printing, printing, end of printing, and discharge of the printing medium P.

Referring to FIG. 15, a indicates a timing chart of supply of a head drive signal to drive a heater 208. When the signal goes High (20 V), ink is discharged. In FIG. 15, b indicates a timing chart of supply of a sub-heater drive signal to drive a sub-heater 207. When the signal goes High (20 V), the sub-heater 207 executes heating to raise the ink temperature. Stripe-like portions of a and b in FIG. 15 indicate that the signal levels High and Low are switched every 10 ns at the shortest.

In FIG. 15, c indicates a time variation in the printhead temperature which changes upon ink discharge and sub-heater heating. The values are obtained based on the output values from a thermistor 315 and a diode sensor 203. As is apparent from c in FIG. 15, the ambient temperature before the start of the printing operation is 25° C.

The series of printing operations will be described next with reference to FIG. 4.

First, at time (t) t=T500, feed of the printing medium P starts. After the printing medium is conveyed in the Y direction (sub-scanning direction) in FIG. 4 up to the upper end of the printable area, feed is ended at t=T501. The time from t=T500 to t=T501 is 1 sec.

Before printing, preliminary discharge during feed is executed to refresh ink in the nozzles. If a printhead 100 is left alone or stands by before printing, the ink viscosity in the nozzles can be high. In this case, ink discharge is impossible without decreasing the high viscosity by raising the ink temperature to a temperature higher than 45° C. at which ink discharge is possible in a normal state. Additionally, since preliminary discharge is executed before printing, the recovery characteristic of the preliminary discharge is preferably improved by raising the ink temperature at a temperature higher than 55° C. optimum for printing. Hence, in this embodiment, at t=Th500, the first-class temperature adjustment process starts. The sub-heater 207 is driven to execute sub-heater heating for 0.02 sec, thereby adjusting the printhead temperature to 65° C. At t=Tf500 when the printhead temperature reaches 65° C., preliminary discharge during feed starts.

However, if the number of discharged ink droplets per unit time in the preliminary discharge during feed is extremely small, the printhead temperature might drop during execution of preliminary discharge until HT≦45° C. To prevent this, in this embodiment, the sub-heater 207 is continuously driven even after the start of preliminary discharge during feed. Control is made to end the drive simultaneously with the end of preliminary discharge. The time necessary for preliminary discharge during feed is 100 (discharged droplets)/24 (kHz) =about 4.2 msec.

After the end of preliminary discharge during feed, the printhead temperature increased upon sub-heater heating and ink discharge of preliminary discharge gradually decreases to the equilibrium state (25° C.).

When feed is ended at t=T501, the printhead 100 located at a home position h moves in the X direction (main scanning direction). The first forward direction printing is executed from t=T501 when the printhead 100 reaches a left end P11 of the printable area to t=T502 when the printhead reaches a right end P12 of the printable area. Since the print scanning speed is 20 inches/sec, the time from t=T501 to t=T502 in which the printhead 100 scans the printable area is 8 (inches) ÷20 (inches/sec)=0.4 sec.

The second-class temperature adjustment process starts at t=Th501 0.05 sec before t=T501 of the start of forward direction printing and finishes at t=T502 when the printhead 100 reaches the right end P12 of the printable area. This process is executed to satisfy the optimum printhead temperature of 55° C. for printing when the printhead 100 reaches the printable area. In the second-class temperature adjustment process executed from t=Th501 to t=T502, the sub-heater 207 is driven during ink non-discharge but not during ink discharge, thereby adjusting the printhead temperature to 55° C.

Figure 16:
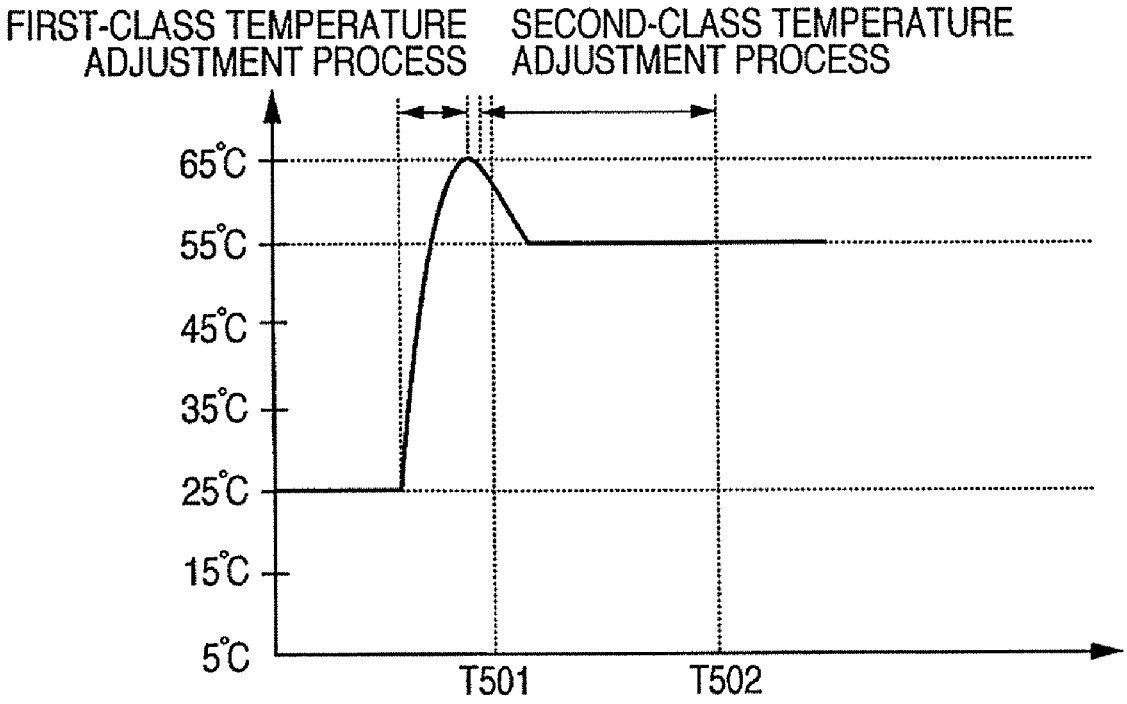
FIG. 16 is a graph showing a time variation in the printhead temperature when control according to the fifth embodiment is executed.
Figure 17:
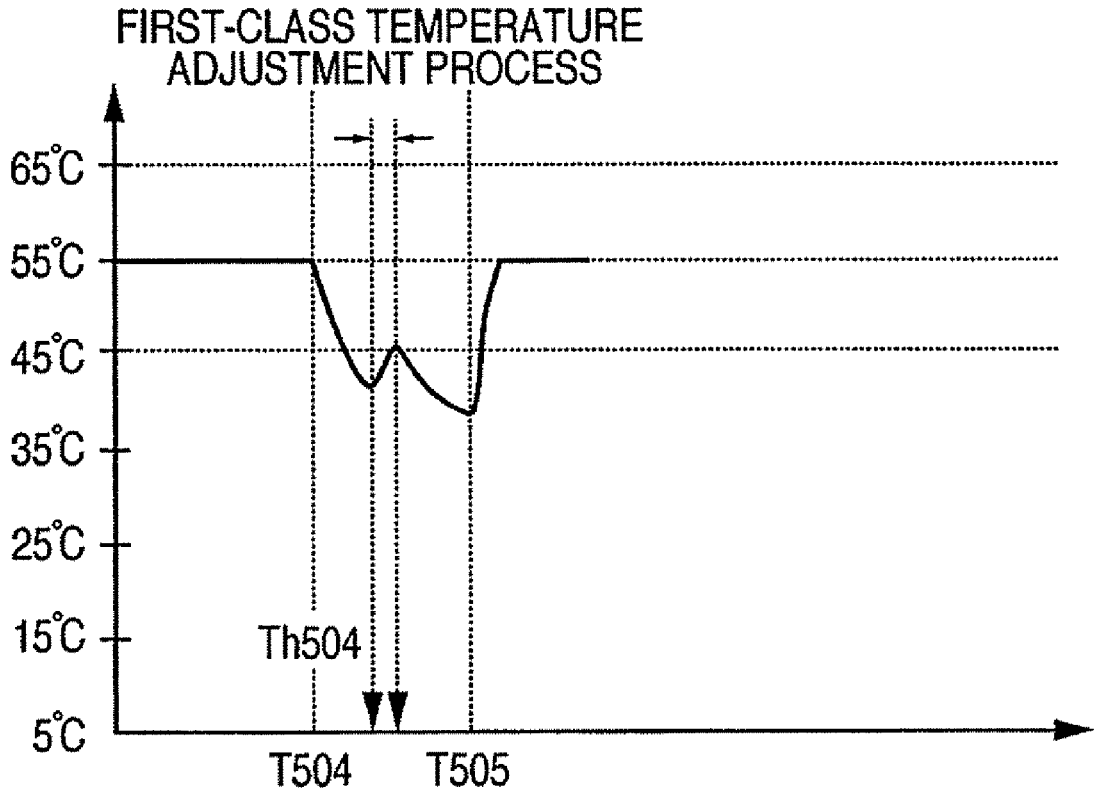
FIG. 17 is a graph showing a time variation in the printhead temperature when printing is performed at an ambient temperature lower than 25° C.

To satisfy the optimum printhead temperature of 55° C. for printing when the printhead 100 reaches the printable area, it is preferable to provide a period without temperature adjustment by sub-heater drive between the first-class temperature adjustment process that raises the printhead temperature to 65° C. and the second-class temperature adjustment process. This is because if no sufficient time exists between the first-class temperature adjustment process and the second-class temperature adjustment process, a period with a printhead temperature of 55° C. or more exists between T501 and T502, as shown in FIG. 16, and the image quality may degrade due to variations in the amount of ink discharge and discharge speed.

After the end of the first forward direction printing, the printing medium P is conveyed from t=T502 to t=T503 to prepare for the next printing. The time from t=T502 to t=T503 is 0.1 sec. During this time, neither ink discharge nor sub-heater heating is performed, and the printhead temperature gradually decreases.

Next, the printhead 100 moves from the scanning direction change point a to the home position h. The first backward direction printing is executed from t=T503 when the printhead 100 reaches the right end P12 of the printable area to t=T504 when the printhead reaches the left end P11 of the printable area. The time from t=T503 to t=T504 in which the printhead 100 scans the printable area in the backward direction is 0.4 sec, as in forward direction printing.

The second-class temperature adjustment process starts at t=Th503 0.05 sec before t=T503 of the start of backward direction printing and finishes at t=T504 when the printhead 100 reaches a left end P11 of the printable area. This process is executed to satisfy the optimum printhead temperature of 55° C. when the printhead 100 reaches the printable area. In the second-class temperature adjustment process executed from t=Th503 to t=T504, the sub-heater 207 is driven in accordance with ink discharge/non-discharge, as in the first forward direction printing.

After the end of the backward direction printing, the printing medium P is conveyed by 1 inch, which is the orifice array width of the printhead 100, during 0.1 sec from t=T504 to t=T505.

Preliminary discharge during printing (discharge in the non-printing state) is executed at t=Tf504 between t=T504 and t=T505 to discharge 10 ink droplets from each orifice of the printhead, thereby refreshing ink in the nozzles. The first-class temperature adjustment process is normally executed here to adjust the printhead temperature to 45° C. that enables ink discharge. However, according to the printhead temperature indicated by c in FIG. 15, the printhead temperature before the preliminary discharge during printing is 48° C. For this reason, in this embodiment, only the preliminary discharge during printing is executed without executing the first-class temperature adjustment process.

In a case where the printhead temperature becomes lower than 45° C. between t=T504 and t=Tf504 since printing is performed at an ambient temperature lower than 25° C., the first-class temperature adjustment process is executed at t=Tf504 to raise the printhead temperature to 45° C., and then preliminary discharge is executed. The execution time of preliminary discharge during printing is 10 (discharged droplets)/24 (kHz)=about 0.42 msec.

After that, from t=T505 to t=T508, the second forward direction printing, conveyance of the printing medium P, and the second backward direction printing are performed, like from t=T501 to t=T504. When the second backward direction printing is ended, discharge of the printing medium P starts at t=T508. At t=T509 after 1 sec, paper discharge is completed, and the printing operation is ended.

In the first-class temperature adjustment process of this embodiment, the printhead temperature in preliminary discharge during feed executed during feed or conveyance of the printing medium P is adjusted to 65° C., and the printhead temperature for preliminary discharge during printing is adjusted to 45° C. When the printhead temperature in the preliminary discharge during feed is set to be high to decrease the ink viscosity, reliable recovery performance can be obtained even under the condition that the viscosity of ink in the printhead left alone or standing by is high. On the other hand, in preliminary discharge during printing, the ink is kept in a relatively fresh state by preliminary discharge during feed or printing. Hence, when the printhead temperature is set to a temperature just for ink discharge, the power consumption can be prevented from increasing more than necessary due to sub-heater drive.

In this embodiment, the temperature retained in preliminary discharge during feed is set at 65° C. that is higher than the temperature (55° C.) retained during printing. This is because to obtain high recovery performance for preliminary discharge before printing, it is preferable to set the temperature retained in preliminary discharge during feed to be higher than the temperature in the second-class temperature adjustment process executed during printing. Additionally, when the printhead temperature in preliminary discharge during feed is adjusted to a temperature higher than the printhead temperature during printing, a period without temperature adjustment is preferably set between the first-class temperature adjustment process in preliminary discharge during feed and the second-class temperature adjustment process in printing. This decreases the temperature to be near the set temperature during printing before the start of printing and stabilizes the printhead temperature immediately after the start of printing.

In this embodiment, the temperature in preliminary discharge during feed is set to be higher than that in preliminary discharge during printing. If ink in the nozzles can be expected to have a low viscosity and, for example, when the second and subsequent pages are to be printed in continuous printing, or the second and subsequent pages are to be printed before capping of the printhead, the temperature in preliminary discharge during feed may be set to be low to suppress power consumption.

In the description of the above embodiments, the printhead discharges only ink to print an image. However, the printhead need not always discharge ink and can also discharge a processed liquid to increase the fixing effect and water repellency of a printed image or increase the printed image quality. That is, the present invention may be an arrangement for printing an image by combining, for example, ink and a processed liquid.

Furthermore, the printing apparatus to which the present invention is applicable can take not only the form of an image output device for an information processing apparatus such as a computer but also the form of a copying machine combined with a reader or a facsimile apparatus having transmitting and receiving functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-001832, filed Jan. 9, 2007, which is hereby incorporated by reference herein in its entirety.

What is claimed is:

1. A printing apparatus which prints an image on a printing medium by scanning a printhead while discharging ink from orifices by thermal energy of printing elements provided on the printhead, comprising:

an adjustment unit configured to adjust a temperature of the printhead to an adjustment temperature, wherein said adjustment unit is configured to execute a first temperature adjustment process of adjusting the printhead temperature to a first adjustment temperature to execute preliminary discharge for discharging, to a portion outside the printing medium, ink that does not contribute to image printing before the image is printed on the print medium, and adjusting the printhead temperature to a second adjustment temperature to execute preliminary discharge during printing on the printing medium, and the first adjustment temperature is higher than the second adjustment temperature.

2. The apparatus according to claim 1, wherein said adjustment unit is also configured to execute a second temperature adjustment process of adjusting the printhead temperature to a third adjustment temperature in a period for printing the image on the printing medium by discharging ink from the orifices, the first adjustment temperature is higher than the third adjustment temperature, and the second adjustment temperature is lower than the third adjustment temperature.

3. The apparatus according to claim 2, wherein said adjustment unit executes the temperature adjustment process while providing a quiescent period without adjustment of the printhead temperature between the first temperature adjustment process and the second temperature adjustment process.

4. The apparatus according to claim 2, wherein said adjustment unit is also configured to execute a third temperature adjustment process of adjusting the printhead temperature to a fourth adjustment temperature lower than the first adjustment temperature, the second adjustment temperature, and the third adjustment temperature.

5. The apparatus according to claim 4, wherein said adjustment unit executes the third temperature adjustment process in a period when neither the first temperature adjustment process nor the second temperature adjustment process is performed.

6. The apparatus according to claim 2, wherein said adjustment unit executes the second temperature adjustment process in a range of a scanning direction of the printhead in an area where the image is printed by discharging ink on the printing medium.

7. The apparatus according to claim 1, further comprising:

printhead temperature detection unit configured to detect the printhead temperature; and a driving unit configured to drive the printing elements in accordance with a drive signal containing a prepulse and a main pulse, wherein said adjustment unit executes the temperature adjustment process by letting said driving unit change a pulse width of the prepulse in accordance with the printhead temperature detected by said printhead temperature detection unit.

8. A printhead temperature retaining control method in a printing apparatus which prints an image on a printing medium by scanning a printhead while discharging ink from orifices by thermal energy of printing elements provided on the printhead, comprising the step of:

adjusting a temperature of the printhead to a first adjustment temperature to execute preliminary discharge for discharging, to a portion outside the printing medium, ink that does not contribute to image printing, wherein the first adjustment temperature, adjusted to execute the preliminary discharge before the image is printed on the printing medium, is higher than a second adjustment temperature adjusted to execute the preliminary discharge during printing on the printing medium.

* * * * *